US008263919B2

(12) United States Patent
Murphy et al.

(10) Patent No.: US 8,263,919 B2
(45) Date of Patent: Sep. 11, 2012

(54) UNMANNED SURVEILLANCE VEHICLE

(75) Inventors: Timothy A. Murphy, Tucson, AZ (US); Crystal J. Taton, Tucson, AZ (US); Leonard S. Raymond, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 941 days.

(21) Appl. No.: 12/323,489

(22) Filed: Nov. 26, 2008

(65) Prior Publication Data

US 2010/0057285 A1 Mar. 4, 2010

Related U.S. Application Data

(60) Provisional application No. 61/092,159, filed on Aug. 27, 2008.

(51) Int. Cl.
*B64D 17/80* (2006.01)

(52) U.S. Cl. ..... 244/3.1; 244/63; 244/147; 244/152

(58) Field of Classification Search ..... 244/3.1, 244/3.24–3.29, 63, 139, 147, 152; 348/144–147
See application file for complete search history.

(56) References Cited

U.S. PATENT DOCUMENTS

| | | | | |
|---|---|---|---|---|
| 4,659,041 | A * | 4/1987 | Dellinger et al. | 244/139 |
| 5,467,681 | A * | 11/1995 | Liberman | 89/1.11 |
| 6,347,764 | B1 * | 2/2002 | Brandon et al. | 244/17.11 |
| 6,392,213 | B1 * | 5/2002 | Martorana et al. | 244/3.1 |
| 6,565,041 | B1 * | 5/2003 | Young et al. | 244/139 |
| 6,758,442 | B2 * | 7/2004 | Bailey | 244/142 |
| 6,840,480 | B2 * | 1/2005 | Carroll | 244/120 |
| 7,283,156 | B1 | 10/2007 | Morgan | |
| 7,410,124 | B2 * | 8/2008 | Miller et al. | 244/63 |
| 7,467,762 | B1 * | 12/2008 | Parsons | 244/3.14 |
| 7,854,410 | B2 * | 12/2010 | Fanucci et al. | 244/49 |
| 2002/0070315 | A1 * | 6/2002 | Hilliard et al. | 244/139 |
| 2004/0196367 | A1 * | 10/2004 | Raymond et al. | 348/144 |
| 2006/0102798 | A1 | 5/2006 | Cox et al. | |
| 2009/0040307 | A1 * | 2/2009 | Rubin | 348/153 |

FOREIGN PATENT DOCUMENTS

| | | |
|---|---|---|
| EP | 0178467 | 9/1985 |
| EP | 0447080 A1 | 9/1991 |
| EP | 0800052 A2 | 10/1997 |

(Continued)

OTHER PUBLICATIONS

Parsch, Andreas, "MMIST CQ-10 SnowGoose", Directory of U.S. Military Rockets and Missiles, (2007), XP002563401, [retrieved online], <http://web.archive.org/web/20071124033631/http://www.designation-systems.net/dusrm/app2/q-10.html>. International Search Report and Written Opinion from corresponding International Application No. PCT/US09/45248.

*Primary Examiner* — Tien Dinh
*Assistant Examiner* — Michael Kreiner
(74) *Attorney, Agent, or Firm* — Renner, Otto, Boisselle & Sklar, LLP

(57) ABSTRACT

A surveillance vehicle (10) comprising a vessel (11) and a parasail (12). The vehicle (10) is loaded, in a pre-launch condition, into a mortar tube for projection therefrom towards an area of interest. In this pre-launch condition, the vessel (11) resembles a conventional mortar round and the parasail (12) is stowed within the vessel (11). Upon arrival at the area of interest, the parasail (12) is deployed from the vessel (11) and instrumentation collects survey data.

20 Claims, 42 Drawing Sheets

FOREIGN PATENT DOCUMENTS

| | | | |
|---|---|---|---|
| JP | 11059595 | | 3/1999 |
| WO | 0107318 | | 2/2001 |
| WO | 2004057263 | A1 | 7/2004 |
| WO | 2005036941 | | 4/2005 |
| WO | 2006001856 | | 1/2006 |
| WO | 2007034468 | | 3/2007 |
| WO | 2007084186 | | 7/2007 |
| WO | 2007133182 | | 11/2007 |

* cited by examiner

UNMANNED SURVEILLANCE VEHICLE

RELATED APPLICATION

This claims priority under 35 U.S.C. §119(e) to U.S. Provisional Patent Application Ser. No. 61/092,159, filed on Aug. 27, 2008. The entire disclosure of this earlier application is hereby incorporated by reference.

GENERAL FIELD

An unmanned surveillance vehicle that is launched into an area of interest to collect visual survey data.

BACKGROUND

Military combat has always been a dangerous undertaking, to say the least. But the threat troops face today is unlike any they have encountered before. The enemy often consists of non-uniformed personnel operating individually or in small groups. And they strike populated urban areas with little or no regard for civilian causalities.

When an urban area is under attack, a common response strategy is to emplace ground forces on the city's outskirt. From this perimeter, buildings (and/or other vertical obstructions) obscure targets. They also create "dead spaces" unreachable by weapons with traditional ballistic trajectories. The enemy can be assumed to take full advantage of the hiding places and blind spots afforded by urban structures. And they can also be expected to niche target operations so that anything but a high-precision hit will result in collateral damage.

For these reasons, accurate and realtime surveillance data can be more critical in an urban combat area than in most other battlefields. At the same time, effective observation in such a setting is dangerous and difficult. An on-foot forward observer is often out of the question, as he quickly becomes a sitting duck for rooftop snipers. Even if a forward observer is lucky enough to slip past unfriendly fire, he may not be able to reach an effective vantage to gather meaningful intelligence.

Aerial surveillance erases most view-point problems and, if an unmanned vehicle is used to collect the survey data, human life is spared. But surveillance aircraft tend to be loud and thus audibly announce their approach to the enemy. And perhaps more importantly, an aerial vehicle (manned or unmanned) may not be available in a timely manner to support ground forces. Aerial surveillance vehicles do not come cheap, and keeping an inventory of even one vehicle near each major city has been considered cost prohibitive. Urban combat commonly occurs suddenly without warning, and waiting for aerial surveillance support to arrive is often not a viable option.

SUMMARY

A surveillance vehicle is provided that can gather meaningful intelligence from an effective vantage point without endangering human life. Visual survey data can be collected and transmitted in real time (or almost real time) to the command unit, so that targets can be immediately identified and pursued. The surveillance vehicle is transportable to a weapon launch site and can be launched from a conventional or standard mortar tube. In this manner, the surveillance vehicle can be initiated in a timely manner to support ground forces, without the need for special or specific launch equipment.

DRAWINGS

FIGS. 1A-1D show the surveillance vehicle 10 in a pre-launch condition, a just-launched condition, a post-launch condition, and a survey condition, respectively.

FIGS. 2A-2F schematically show the surveillance vehicle 10 launched and then loitered to survey an area of interest.

FIG. 3 shows certain parts of the vehicle's vessel 11, namely a canister 30 (partially removed), a sail-deployer 31, and an instrument bank 32.

FIGS. 4A-4H shows the stage-by-stage condition of vessel 11 when the vehicle 10 is converted from the post-launch condition to the survey condition.

FIG. 5 schematically shows the vehicle's instrument bank 32.

FIG. 6 schematically shows a command unit 23 receiving surveillance data from the vehicle 10.

FIGS. 7A-7C collectively diagram a sequence of steps (and the involved components) from launch to target pursuit.

FIGS. 8A-8E each diagram a sequence of steps (and the involved components) for ascertaining the vehicle's arrival at the area of interest.

FIG. 9A is a schematic drawing a survey-data collector (e.g., a camera) and its mounting to the vehicle canister 30.

FIGS. 9B-9D each diagram a sequence of steps for moving a collecting lens to change its field of view.

FIGS. 10A-10D each diagram a sequence of steps for moving the vehicle 10 within the area of interest.

FIGS. 11A-11E each diagram a sequence of steps for self-destructing the vehicle 10.

FIGS. 12A-12B each show a dead-space target and the pursuit thereof, the dead space being caused by a building in FIG. 12A and by a mountain in FIG. 12B.

DESCRIPTION

Figure 1A:
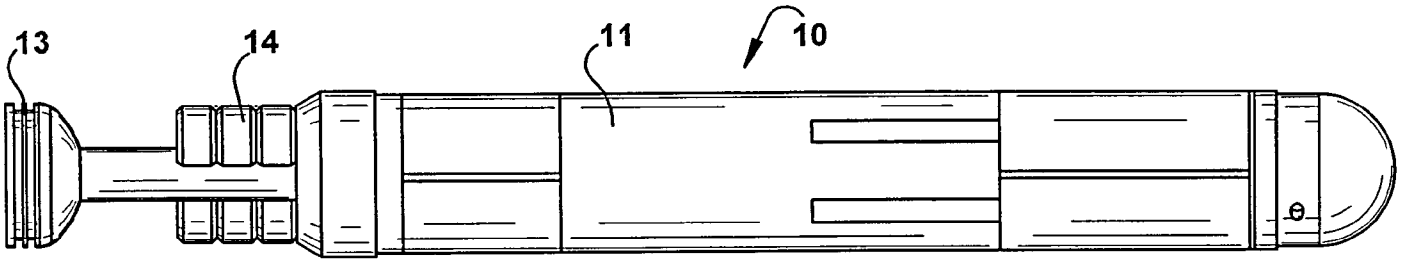
Figure 1B:
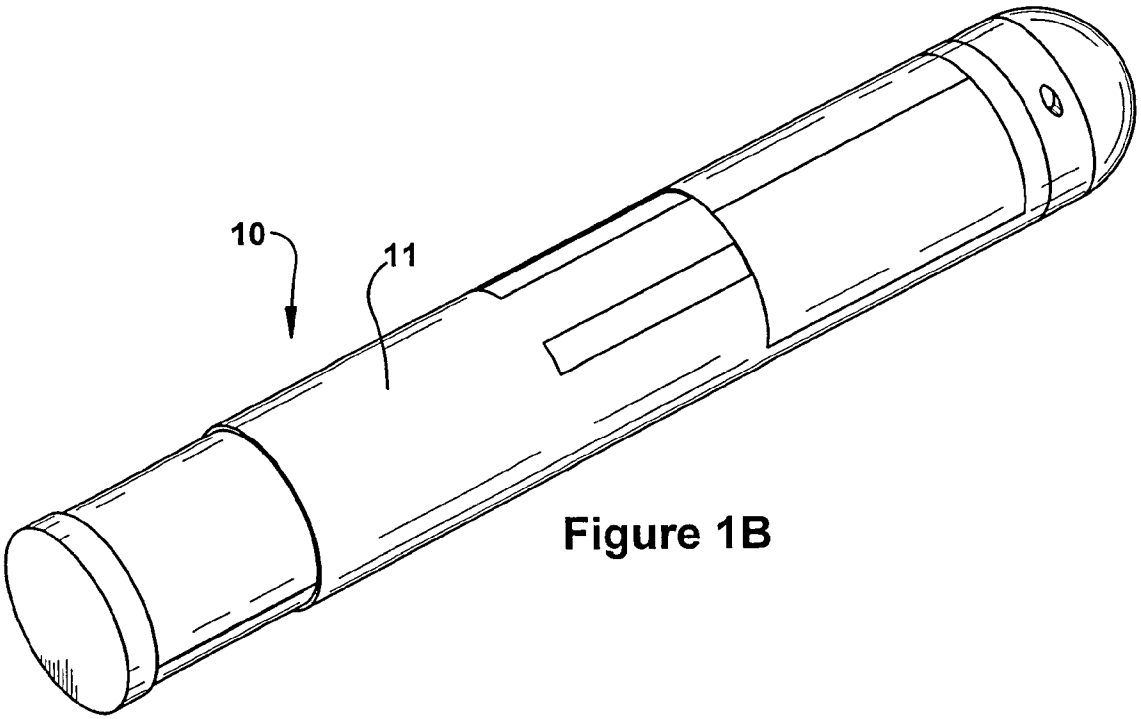

Referring now to the drawings, and initially to the FIGS. 1A-1D, a surveillance vehicle 10 is shown that can gather meaningful intelligence from an effective vantage point without endangering human life. With the vehicle 10, a surveillance mission can be initiated in a timely manner to support ground forces. And visual survey data can be collected and transmitted in real time.

Figure 1D:
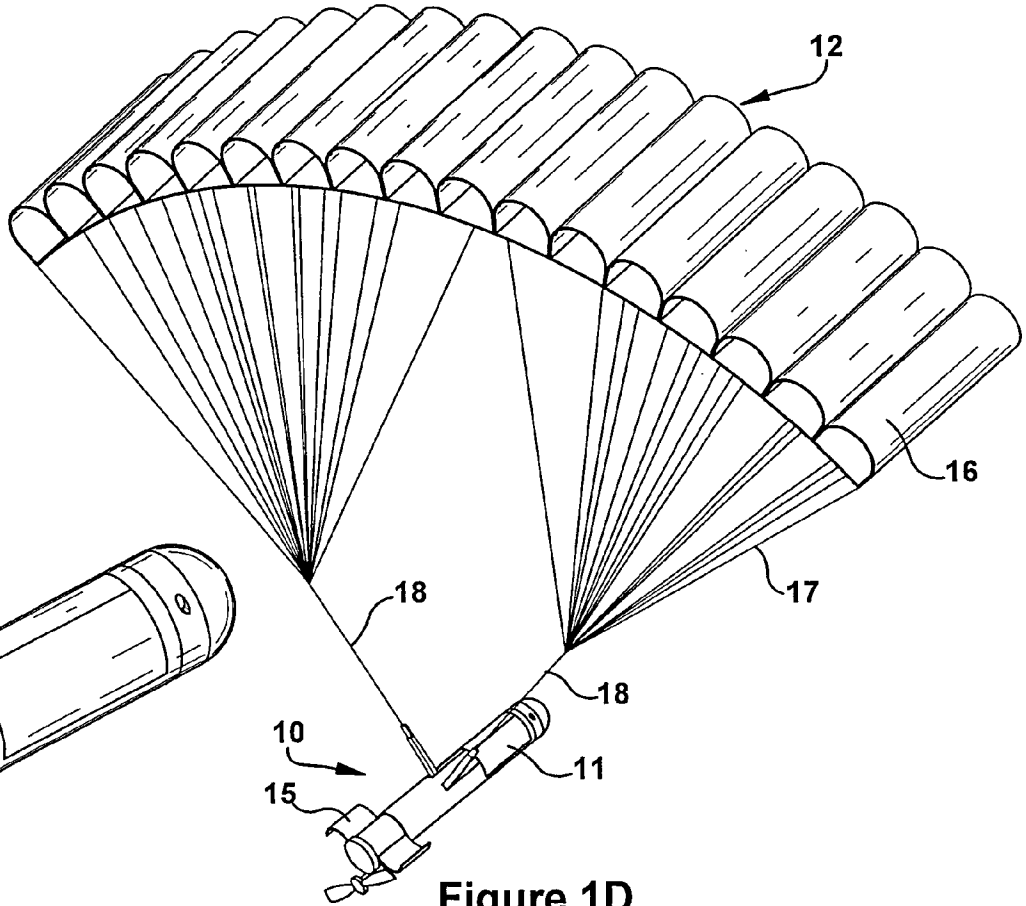
Figure 1C:
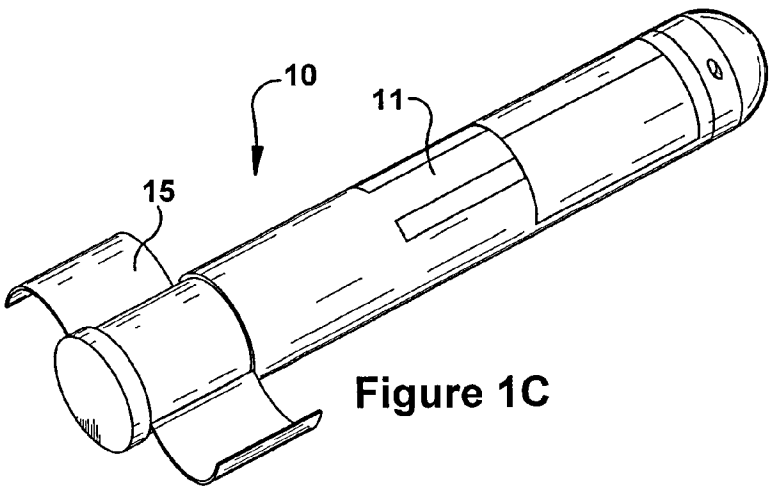

The vehicle 10 generally comprises a vessel 11 (FIGS. 1A-1D) and a parasail 12 (FIG. 1D). In a pre-launch condition (FIG. 1A), a tail 13 and propellant 14 are attached to the vessel 11. In a just-launched condition (FIG. 1B), the tail 13 falls away from the vessel 11 and the propellant 14 burns off. In the post-launch condition (FIG. 1C), the vessel's flight fins 15 span outward.

In the pre-launch, just-launched, and post-launch conditions (FIGS. 1A-1C), the parasail 12 is stowed within the vessel 11. In the survey condition (FIG. 1D), the parasail 12 is deployed to allow the vessel 10 to float at an elevated altitude (e.g., of at least 100 feet). The parasail 12 comprises a canopy 16, chords 17 connected to the canopy 16, and pull lines 18 connecting the chords 17 to the vessel 11. The parasail 12 can be colored to blend in with the sky for camouflage purposes.

The pull lines 18 can be attached to a movement member within the vessel 11 (e.g., a servo-activator) which pulls/pivots the lines 18 to direct travel of the vehicle 10 after parasail 12 is deployed.

Figure 2A:
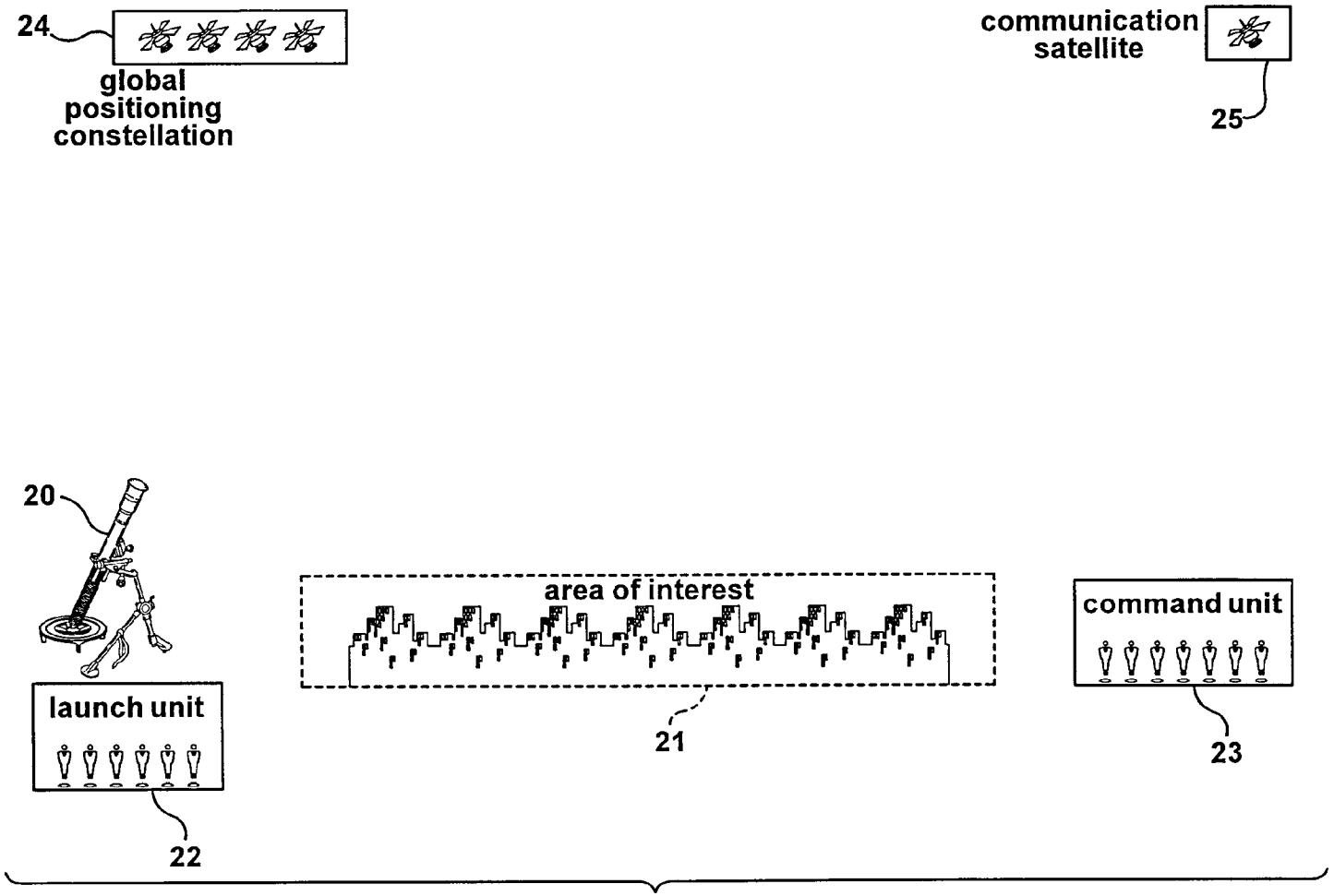
Figure 2B:
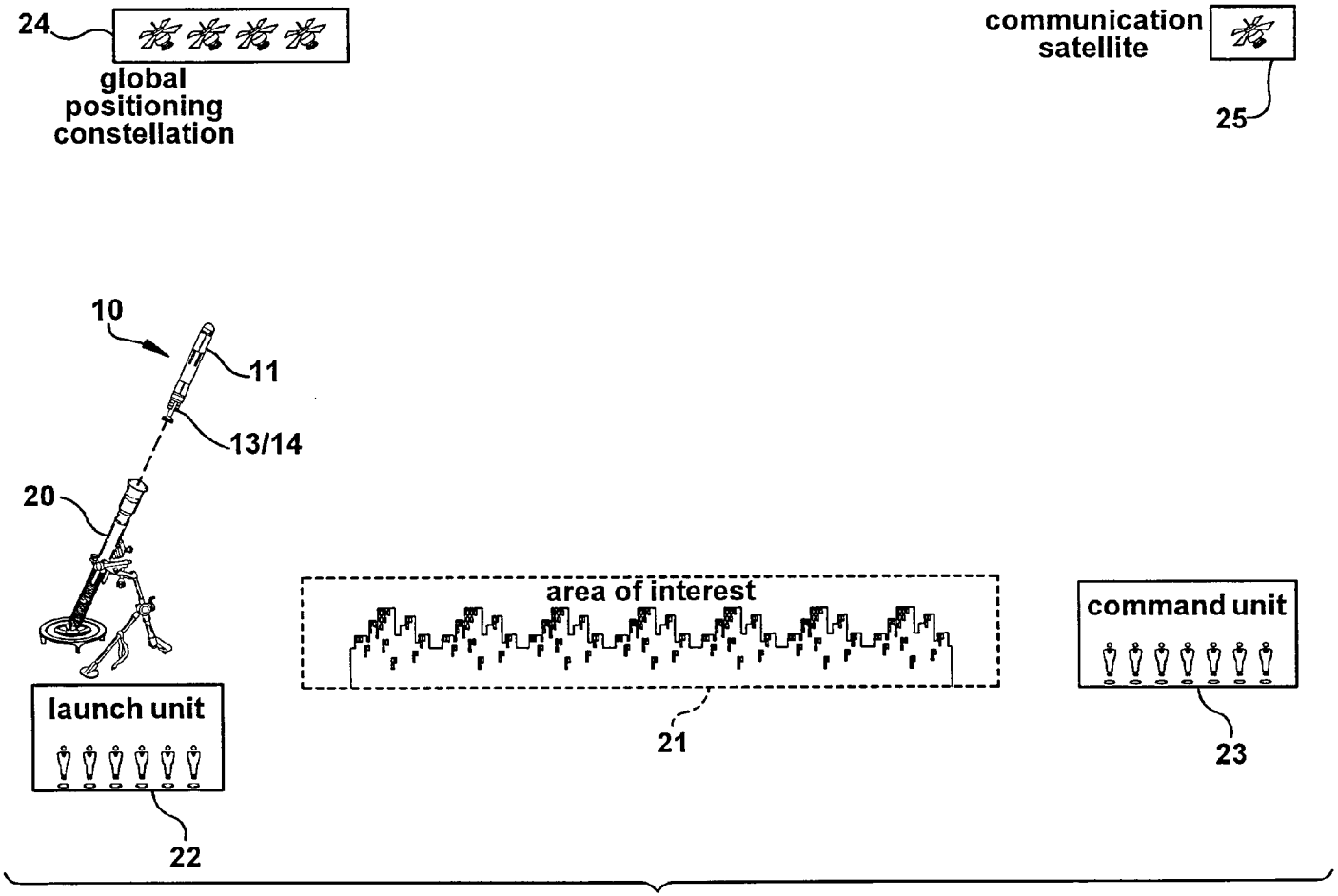

Referring now to FIGS. 2A-2E the surveillance vehicle 10 is schematically shown in a combat context. In FIG. 2A, the vehicle 10 is in its pre-launch condition and loaded in a conventional (and/or standard) mortar-launch tube 20. In FIG. 2B, the vehicle 10 is launched towards an urban area of interest 21. The launching can be performed by a launch unit 22, as commanded by a command unit 23, these units (as well as the launch tube 20) being located remote from the area of interest 21 (e.g., on the city's outskirt).

Figure 2C:
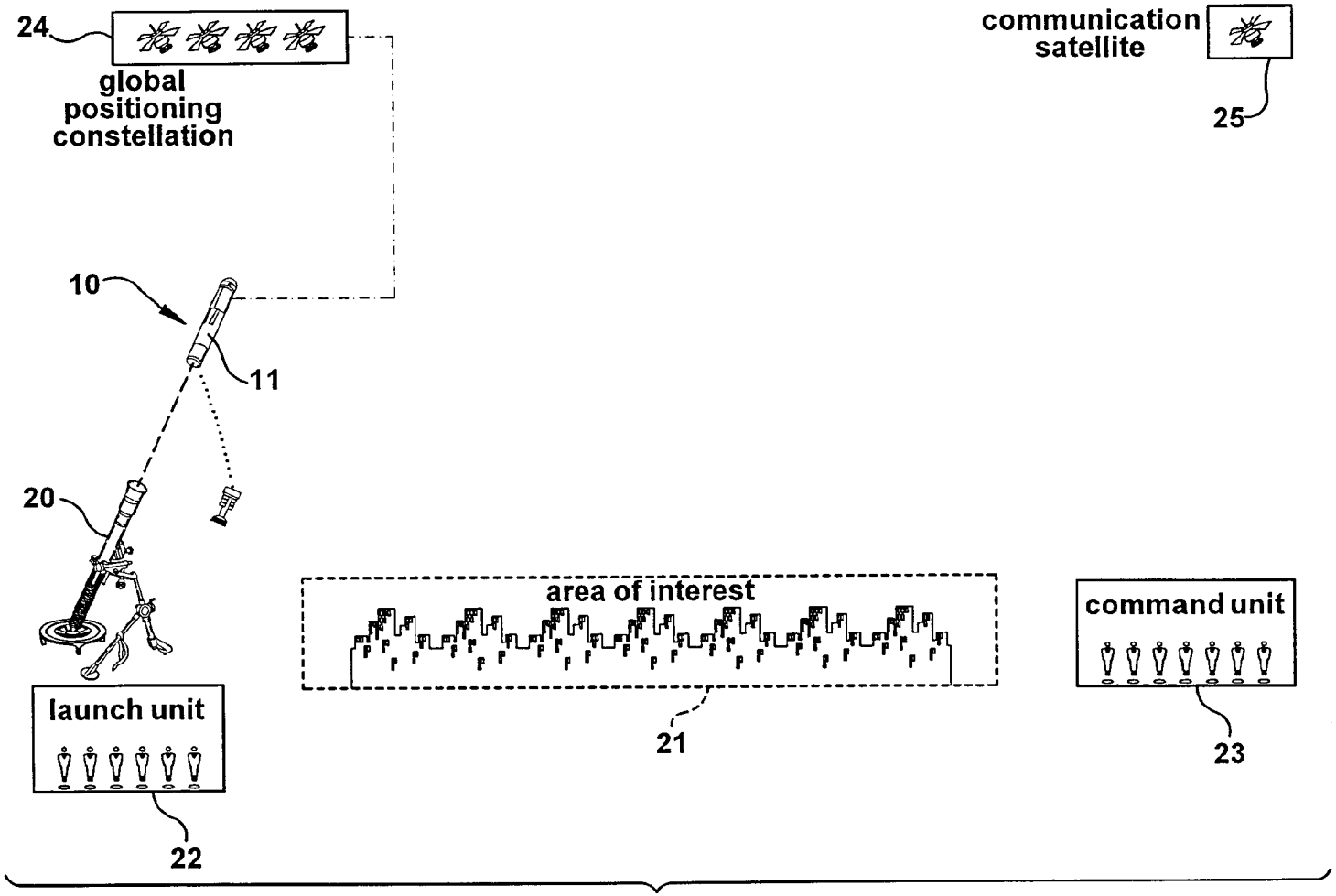
Figure 2D:
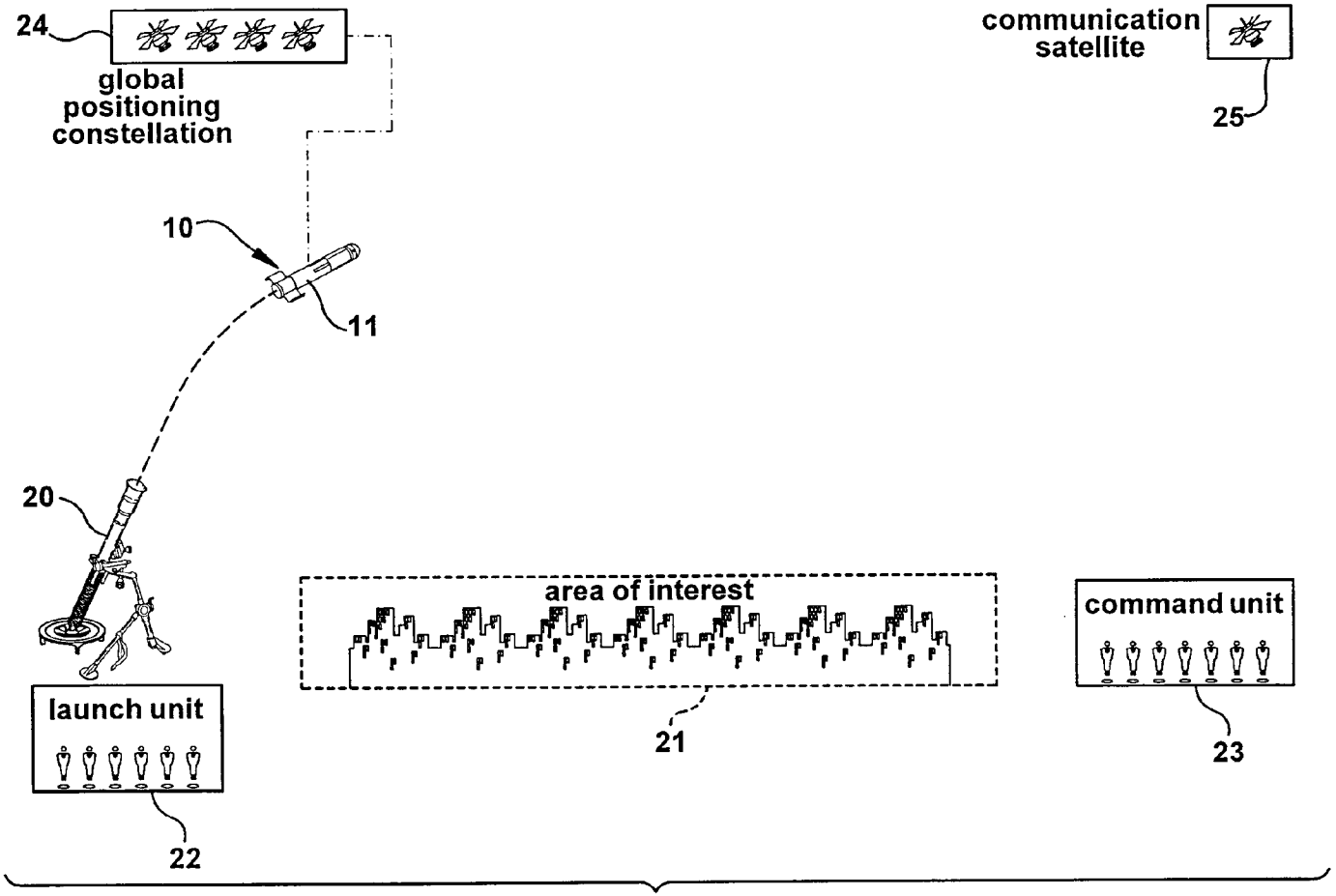
Figure 2E:
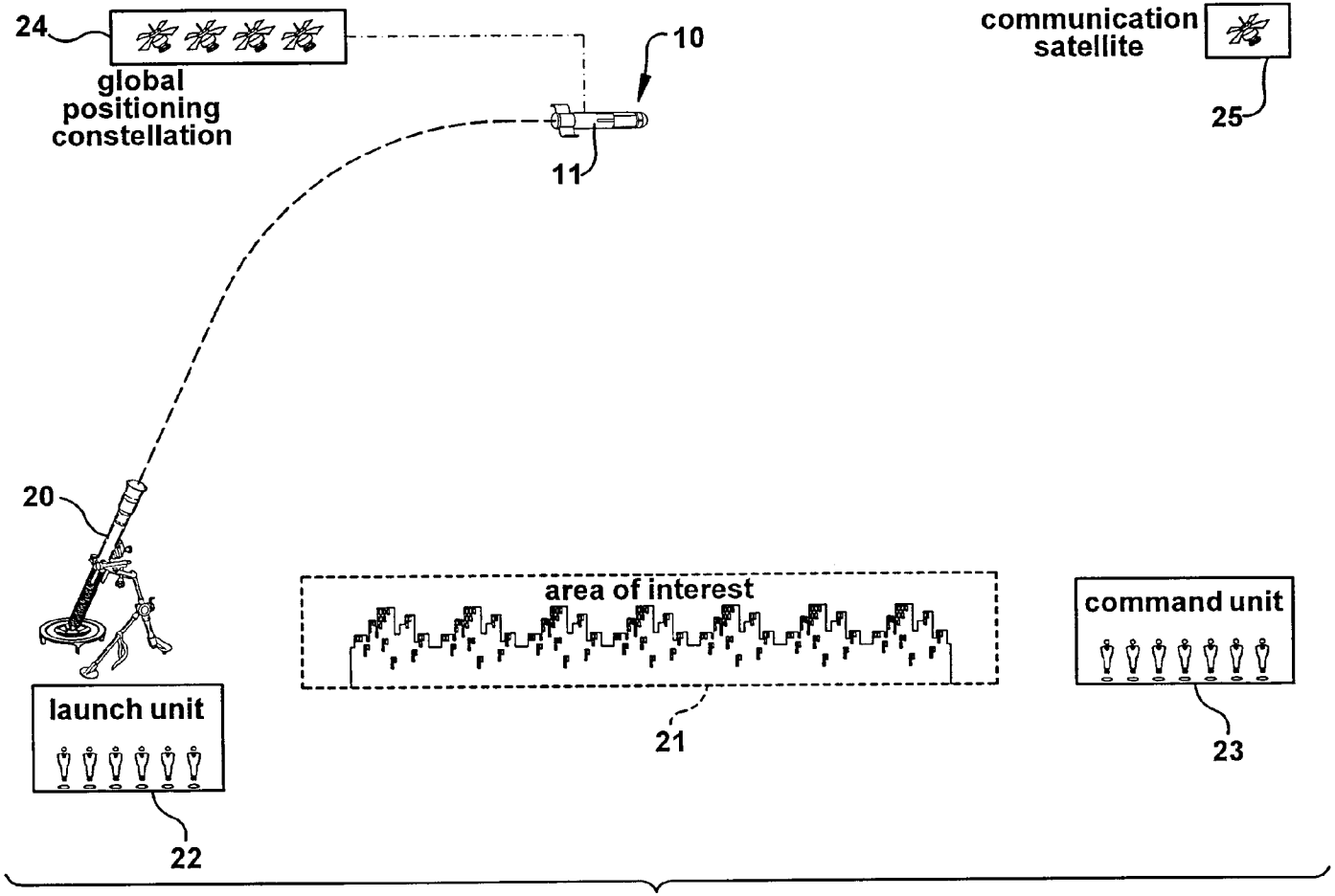
Figure 2F:
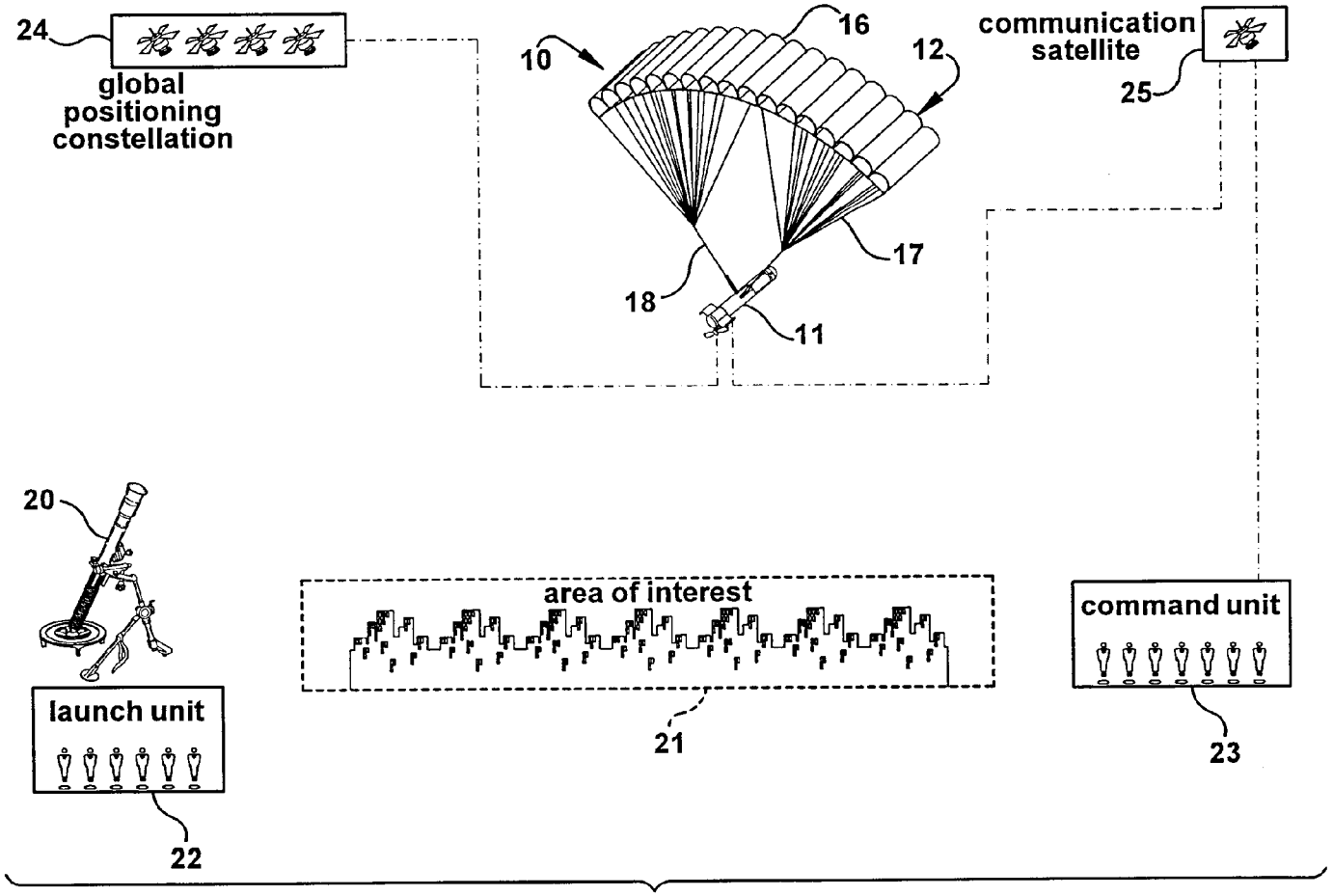

In FIGS. 2C and 2D, the vehicle 10 is in the post-launch condition, traveling towards the area of interest 21 and obtaining its current global position from the GPS constellation 24. The vehicle 10 follows a traditional ballistic trajectory and, in FIG. 2D, reaches the level of the trajectory. In FIG. 2E, the vehicle 10 is in its survey condition, whereat the vessel 11 floats above the area of interest 21, thanks to the deployed parasail 12. The vehicle 10 transmits data to, and receives data from, the command unit 23, via a communication satellite 25.

Figure 3:
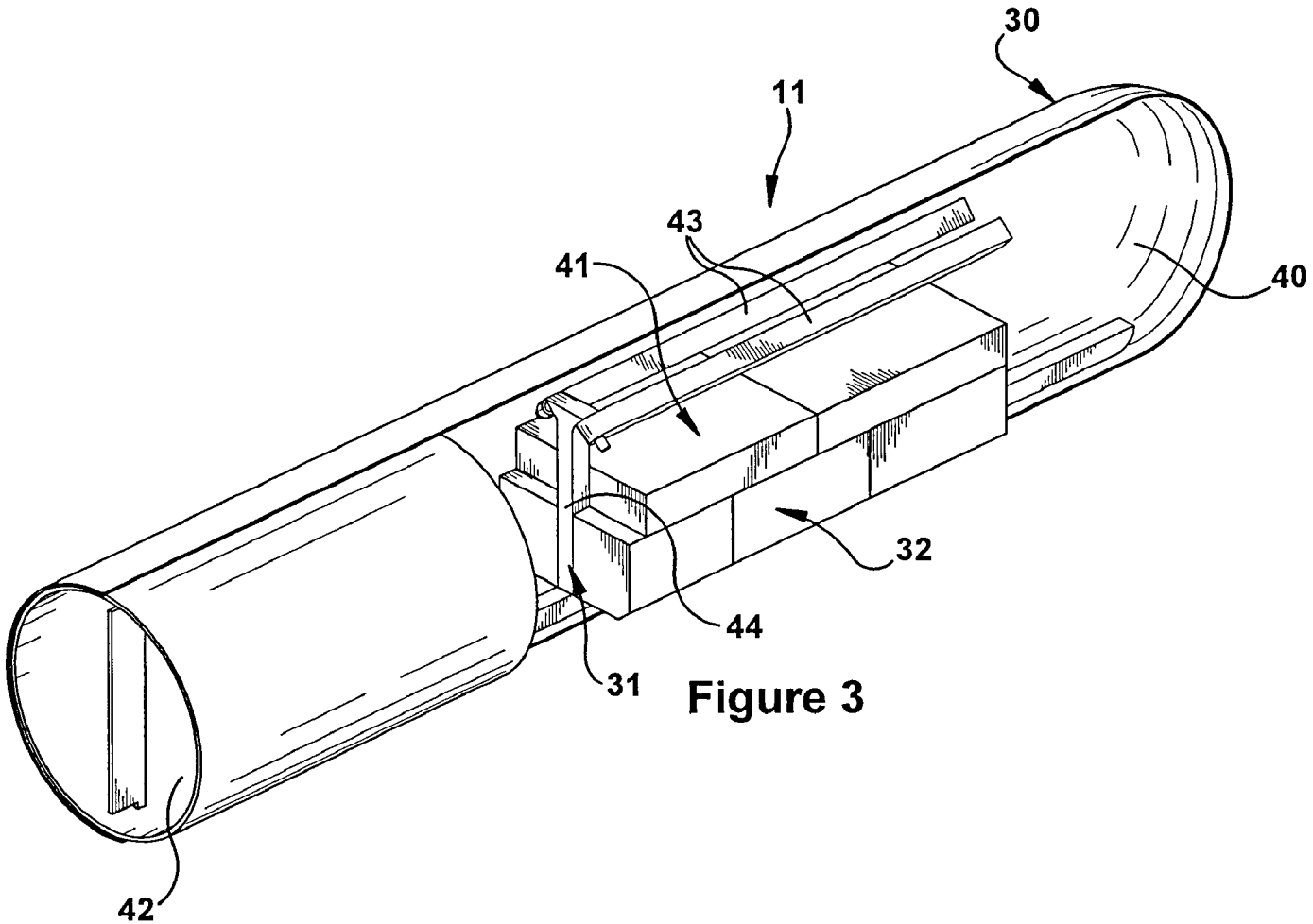

Certain parts of the vessel 11 are shown isolated from the parasail 12 in FIG. 3. The vessel 10 comprises a canister 30, a sail deployer 31, and an instrument bank 32. And as can be seen by briefly referring to FIGS. 4G-4H, the vessel 10 also comprises a propulsion device 33.

The canister 30 comprises a stowage space 40 in which the parasail is stowed, a chamber 41 which houses the instrument bank 32, and a compartment 42 holding the propulsion device 33. The sail deployer 31 has arms 43 that reach into the sail stowage space 40. The deployment arms 43 are pivotally mounted to a pedestal 44 located in or adjacent to the instrument chamber 41. Prior to deployment (and as shown in FIG. 3), the arms 43 are angled perpendicular to the pedestal 44. The parasail's pull lines 18 can be attached to the distal ends of the arms 43 (as well as the pulling members discussed above).

FIGS. 4A-4H show the stage-by-stage state of the vessel 11 as the vehicle 10 is converted from its post-launch condition to its survey condition. These figures also show that the sail stowage space 40 is enclosed by doors 45 and, with particular reference to FIG. 4E, that the compartment 42 has a cover 46.

Figure 4A:
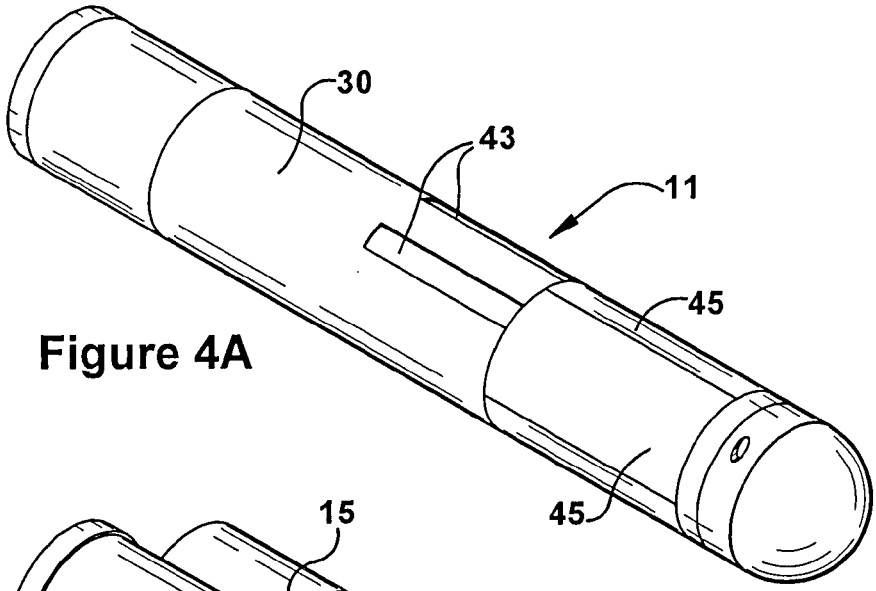
Figure 4B:
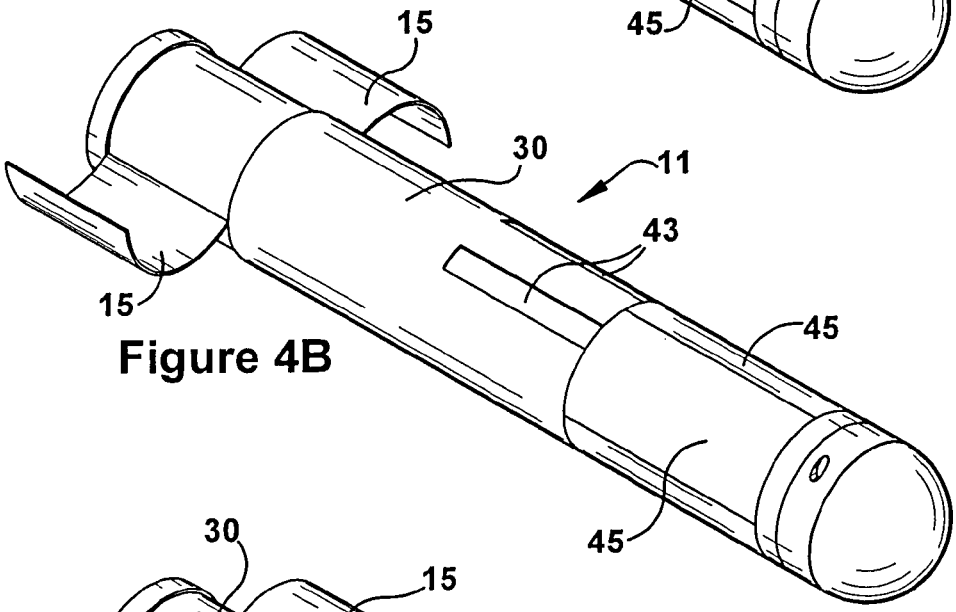
Figure 4C:
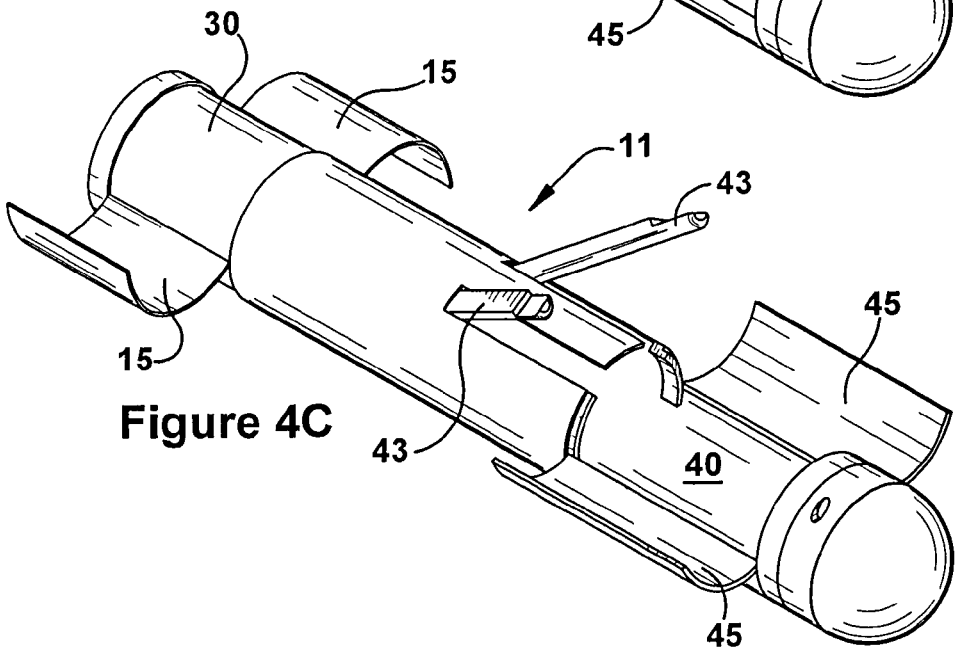
Figure 4D:
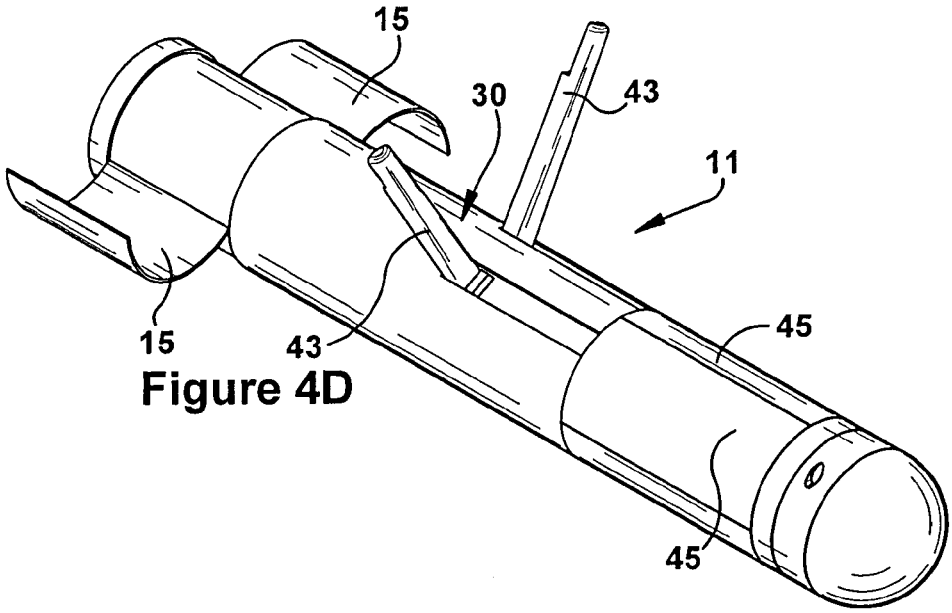
Figure 4E:
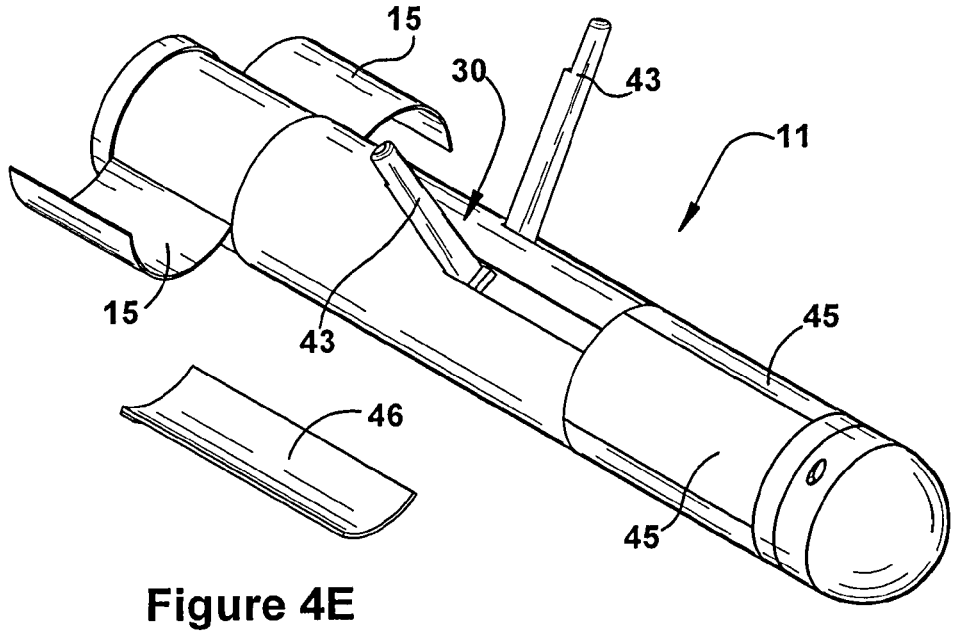
Figure 4F:
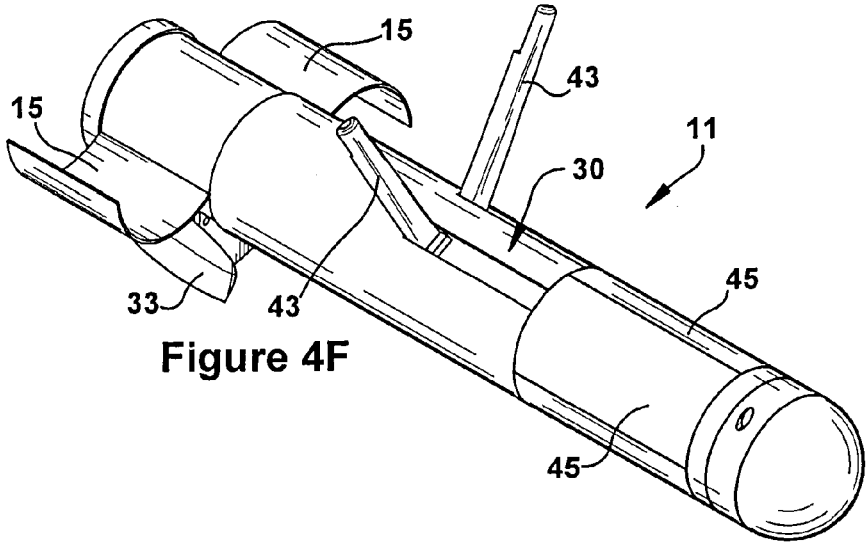
Figure 4G:
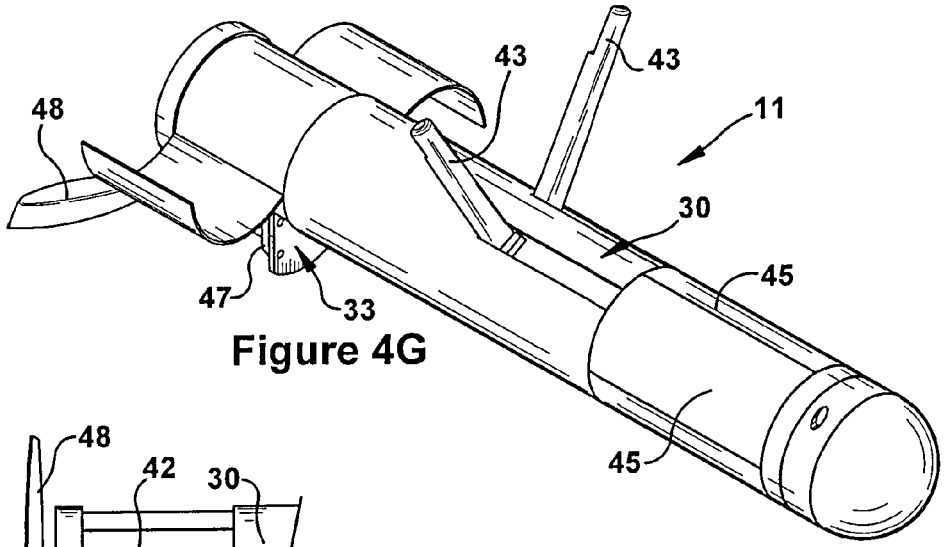
Figure 4H:
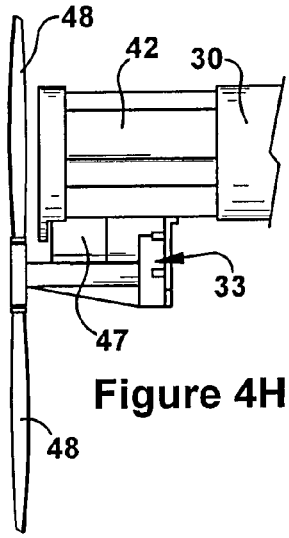

The vessel 11 begins as cylindrical bullet-like shape defined by its canister 30 and resembling a conventional mortar round. (FIG. 4A.) The fins 15 almost immediately spread outward from the canister 30 to steady the flight of the vehicle 10. (FIG. 4B.) When deployment of the parasail 12 begins, the deployer arms 43 lift upward and the doors 45 swing open. (FIG. 4C.) Upon complete parasail deployment, the arms 43 are fully upright and the doors 45 re-closed (FIG. 4D.) The cover 46 on the propulsion compartment 42 then falls away from the canister 30, the propeller's motor 47 then drops, and the propeller's blades 48 then unfold. (FIGS. 4E-4H.)

Figure 5:
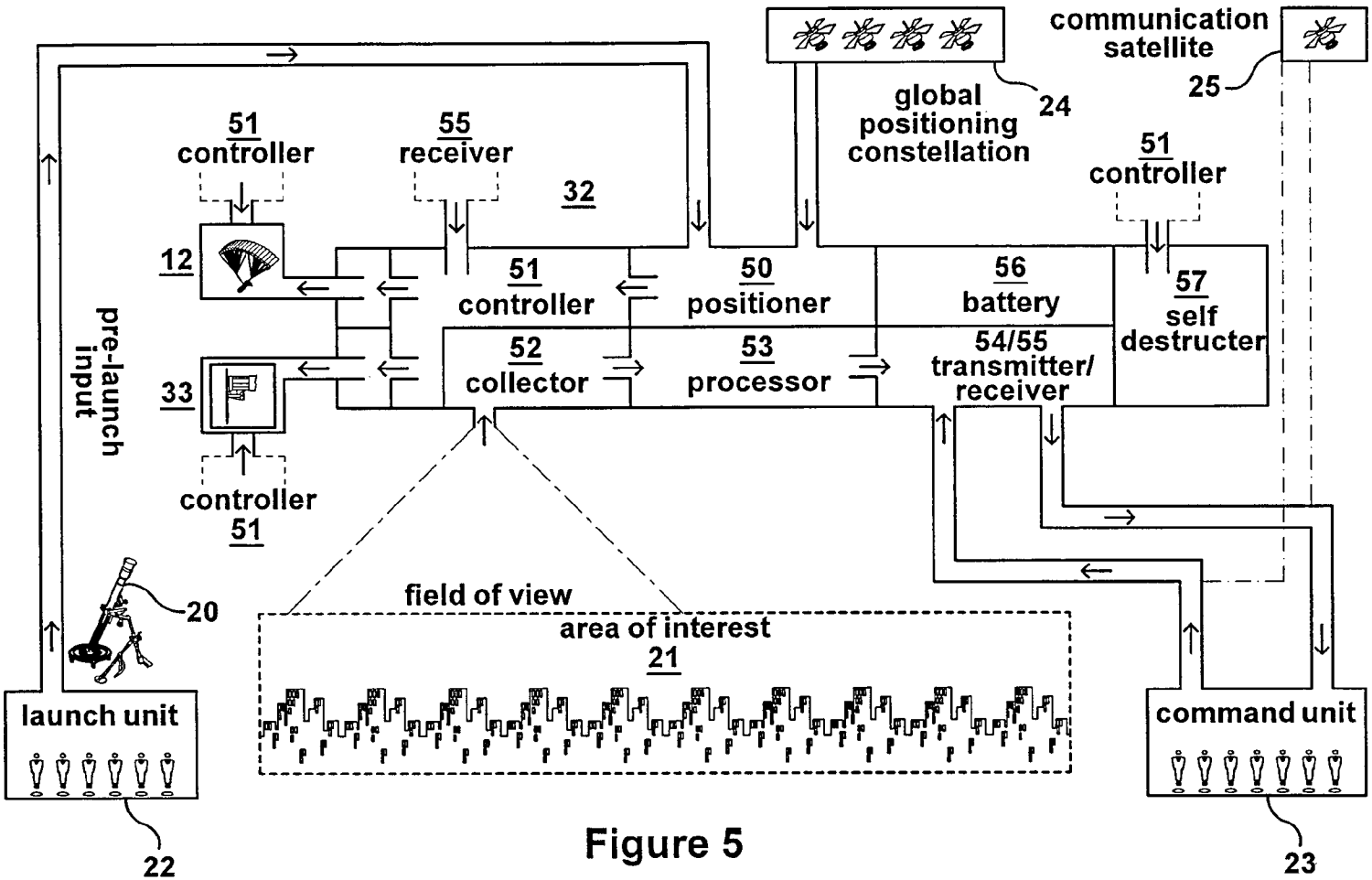

FIG. 5 schematically shows the instrument bank 32 of the vehicle 10, and its interaction with other components in a combat context. The instrument bank 32 comprises a positioner 50, a controller 51, a collector 52, a processor 53, a transmitter 54, a receiver 55, a battery 56, and a self destructor 57.

The positioner 50 has an input for inputting the global position of the area of interest 21 by the launch unit 22 and an antenna for obtaining the global position of the vehicle 10 from the constellation 24.

The controller 51 provides all of the computational processing to guide the surveillance unit using initial and real time GPS coordinates, preprogrammed flight paths, radio control and additional battlefield controls. Flight parameters include location, velocity, height and orientation. Coordinate calculations can be made either in the surveillance processor or in the ground control unit. Changes in the flight path and parameters are made in real time.

The collector 52 can be a camera designed to generate real time video with an appropriate resolution (e.g. 5.0 to >10 mega-pixels), Camera design can include image stabilization techniques in the form of internal lens stabilization, image plane stabilization and/or platform stabilization. The collector 52 can be designed using a single lens and with multiple detectors, or separate lenses could be used with the timing synchronized so that the images could be processed to generate composite images that will provide enhanced images for rapid determination of targets. Lenses can withstand the high-g acceleration during launch. A telephoto lens can be provided to allow zoom in on a given target for positive identification while also being able to give a wide field of view. The collector 52, and/or its collecting lens, can be shielded prior to arrival in the area of interest 21 by, for example, the cover 46 or another openable component.

The processor 53 can provide multi-spectral imaging for significant enhancement to a video image with increased target detection of objects on the ground that are camouflaged or that appear to be targets and are not. Image enhancement is crucial to rapid interpretation of battlefield images and information. Targets on the battlefield want to remain hidden or camouflaged. The real time processing of video reduces the stress of image interpretation on the battlefield and greatly decreases the time needed to find and verify targets. Enhancement of the image can help prevent mistaking non-threatening areas, equipment or people from becoming targets. The processor 53 can also compensate for vessel movement.

The transmitter 54 and the receiver 55 allow communication to and from the command unit 23 (and/or other locations), in conjunction with, for example, the communication satellite 25. The transmitter 54 can be selected to send video images in real time as well as telemetry and GPS data to the ground control unit. The transmitted signal can also be available to remote command units, aircraft and satellites and/or integrated into the overall battlefield communications system. The receiver 55 can be a high frequency receiver and designed to minimize the effects of attempted jamming of the receiver.

The battery 56 can be any power source capable of supplying the necessary power for electronics and flight controls, for a suitable period of time the batteries could be rechargeable or of a single charge battery pack with a long term storage capacity. Lithium-Ion and metal hydride high energy density batteries will usually have sufficient capacity to power the system over the intended flight time of the surveillance vehicle 10.

The self destructor 57 can be a small explosive charge or some other means of rendering the vehicle 10 useless to the enemy when its mission is completed or otherwise exhausted.

Although the vehicle 10 is described primarily as a means for visually surveying the area of interest 21, it could be adapted to serve other purposes. For example, the camera-like collector 52 could be replaced or supplemented with an NBC (nuclear, biological, and chemical) detection equipment could be installed to survey areas subjected to chemical attack or industrial accidents. Jamming equipment could be installed to deny the use of radio communications in a specific area. Alternatively, the unit could potentially be used as a repeater for short range communication equipment. If the instrument bank 32 is constructed in a modular fashion (as illustrated), such replacements or supplements could be efficiently accomplished.

Figure 6:
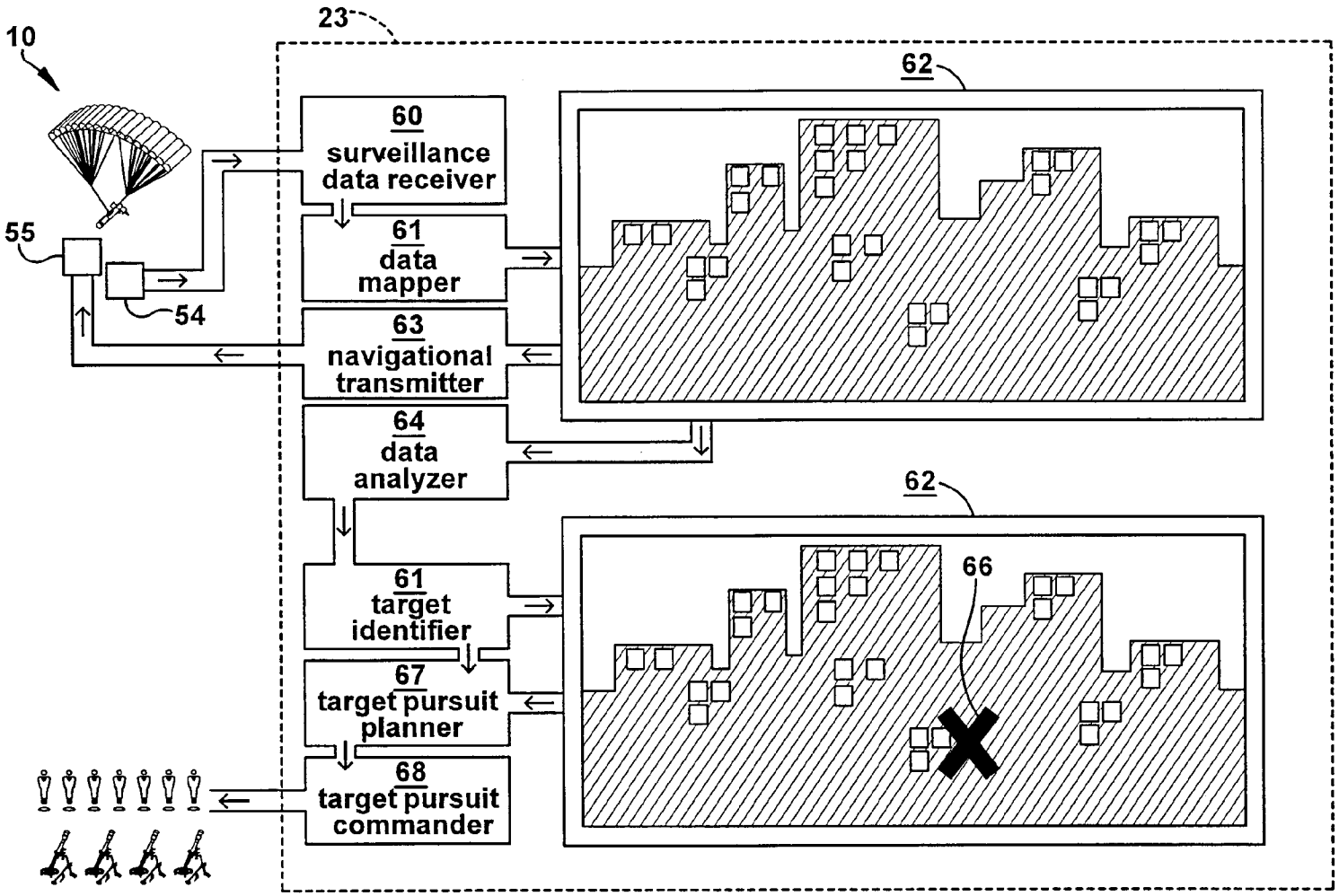

FIG. 6 schematically shows the command unit 23. The illustrated unit 23 comprises a receiver 60 for receiving survey data from the vehicle 10 (particularly its transmitter 54), a mapper 61 for mapping the survey data, and an image screen 62 for visually displaying the survey data. The command unit 23 also comprises a transmitter 63 for transmitting navigation directions to the vehicle 10 (and particularly its receiver 55). An analyzer 64 analyzes the survey data, a target identifier 65 identifies a target 66, a planner 67 plans the pursuit of the target 66, and a commander 68 orders the pursuit.

Figure 7A:
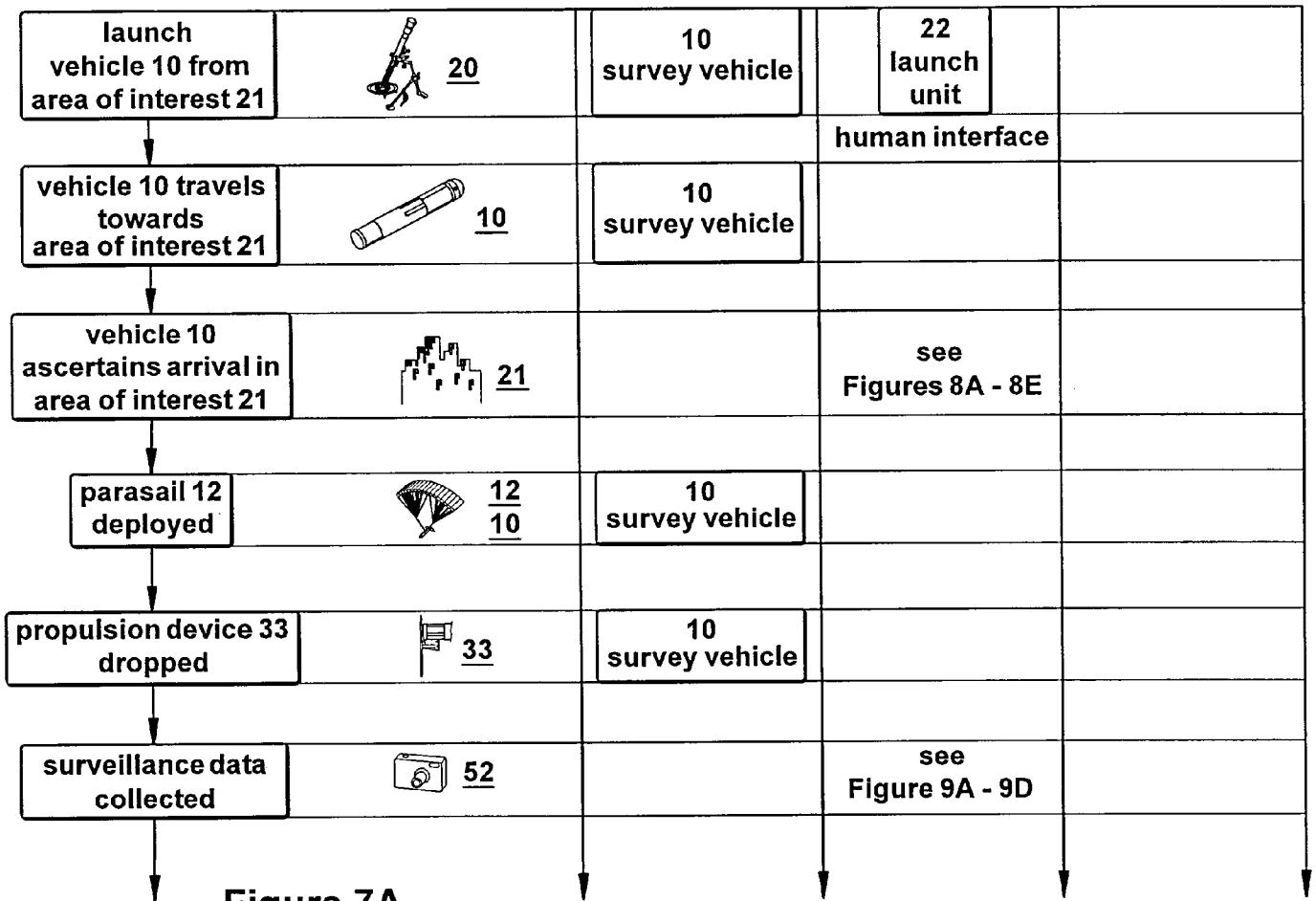
Figure 7B:
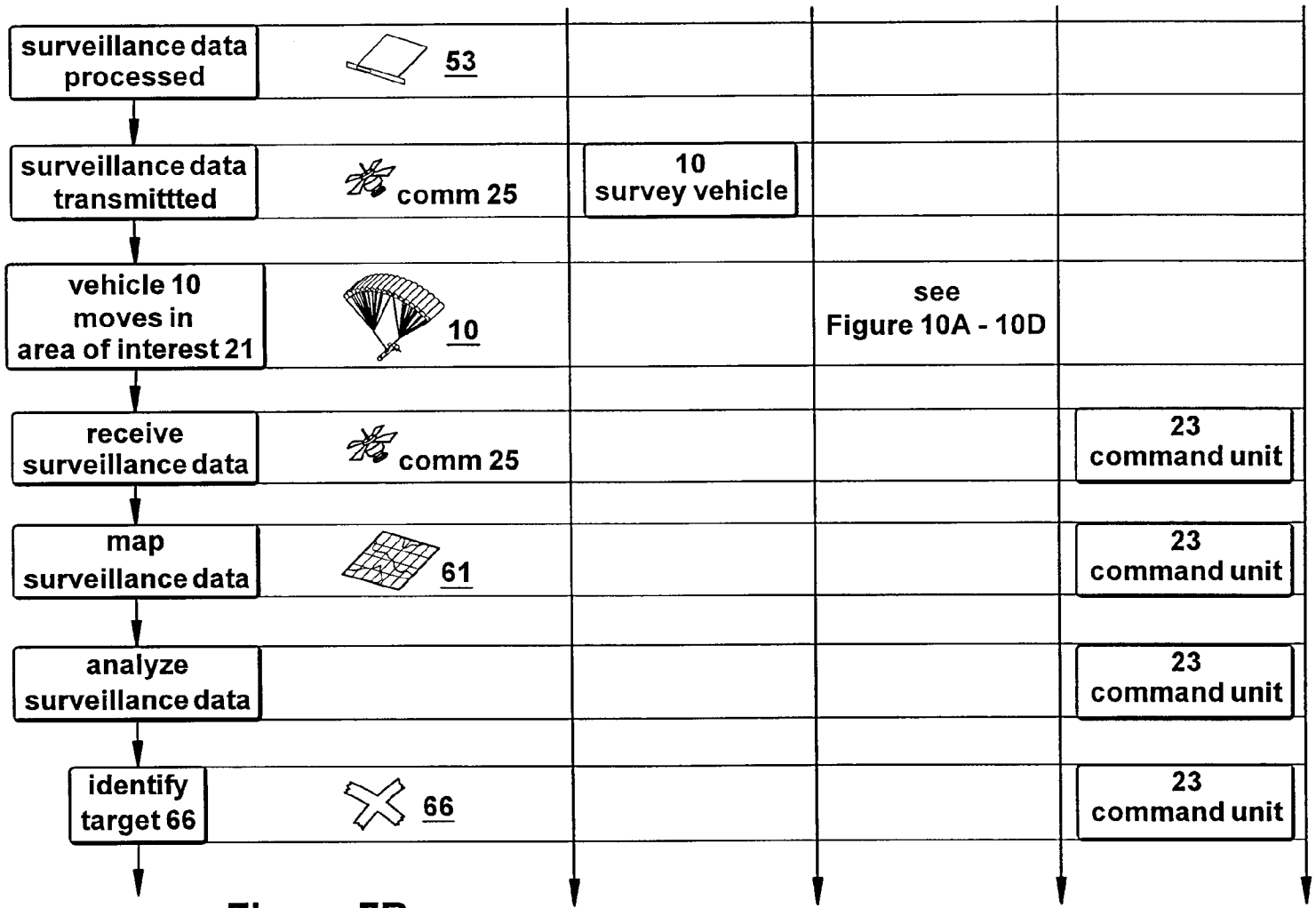
Figure 7C:
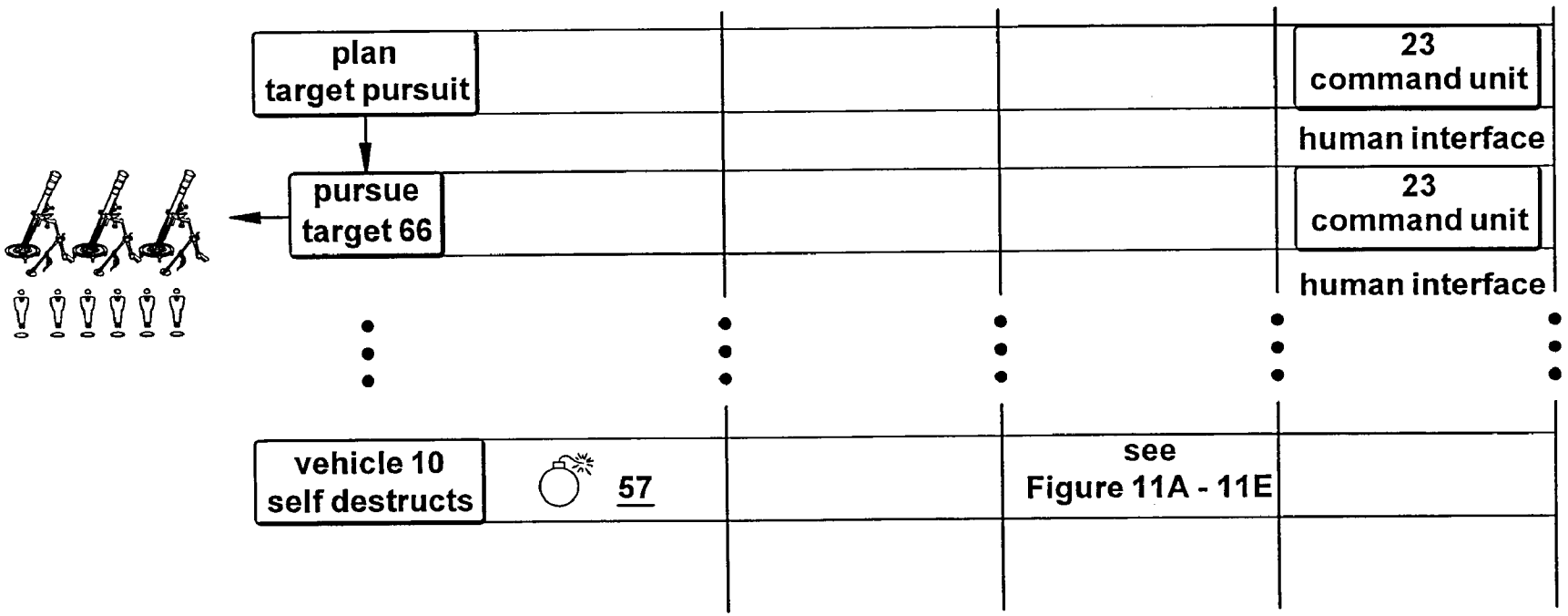

FIGS. 7A-7C collectively diagram the sequence of steps (and the involved components) from launch to target pursuit in a combat context. Initially, the vehicle 10 is launched from the launch tube 20 and travels towards the area of interest 21. (FIG. 7A.) The actual launch of the vehicle 10 can be initiated by the launch unit 22 and, in most instances, will require human interface. While the command unit 23 in most instances orders the launch, it is not directly involved in the initiation logistics. That being said, the launch unit 22 and the command unit 23 could be the same unit and/or the command unit 23 could legislate launch initiation.

Figure 8A:
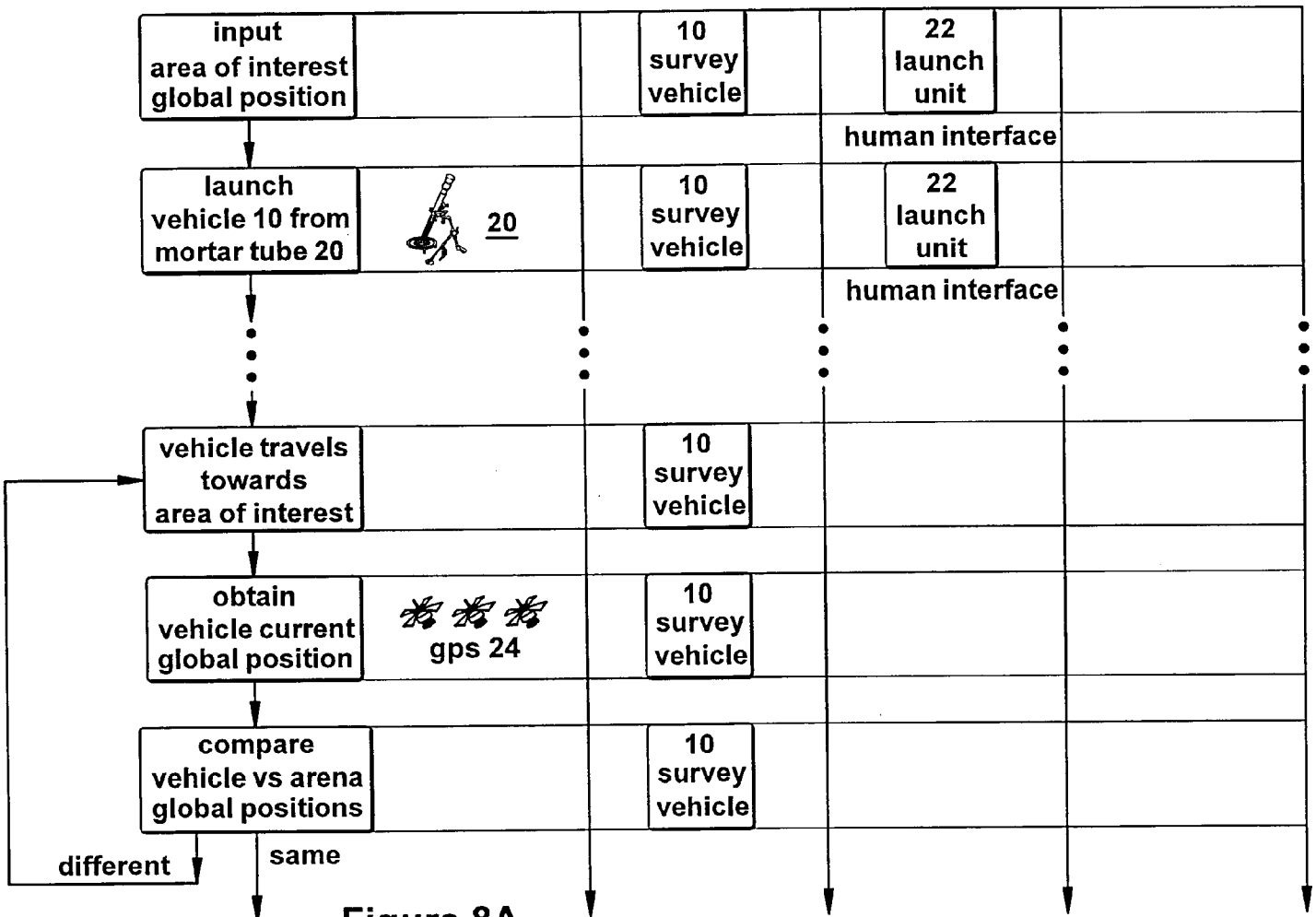
Figure 8B:
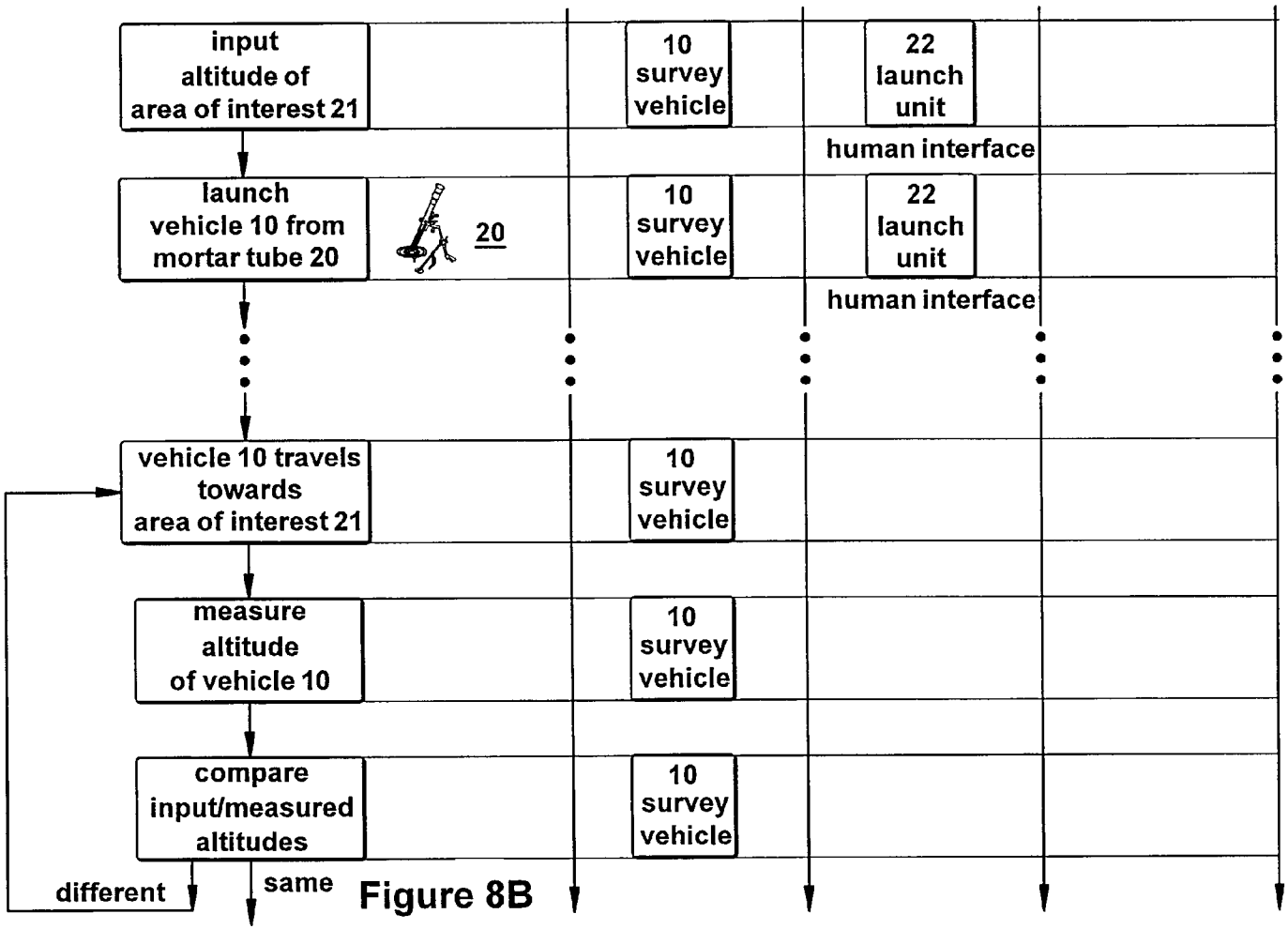
Figure 8C:
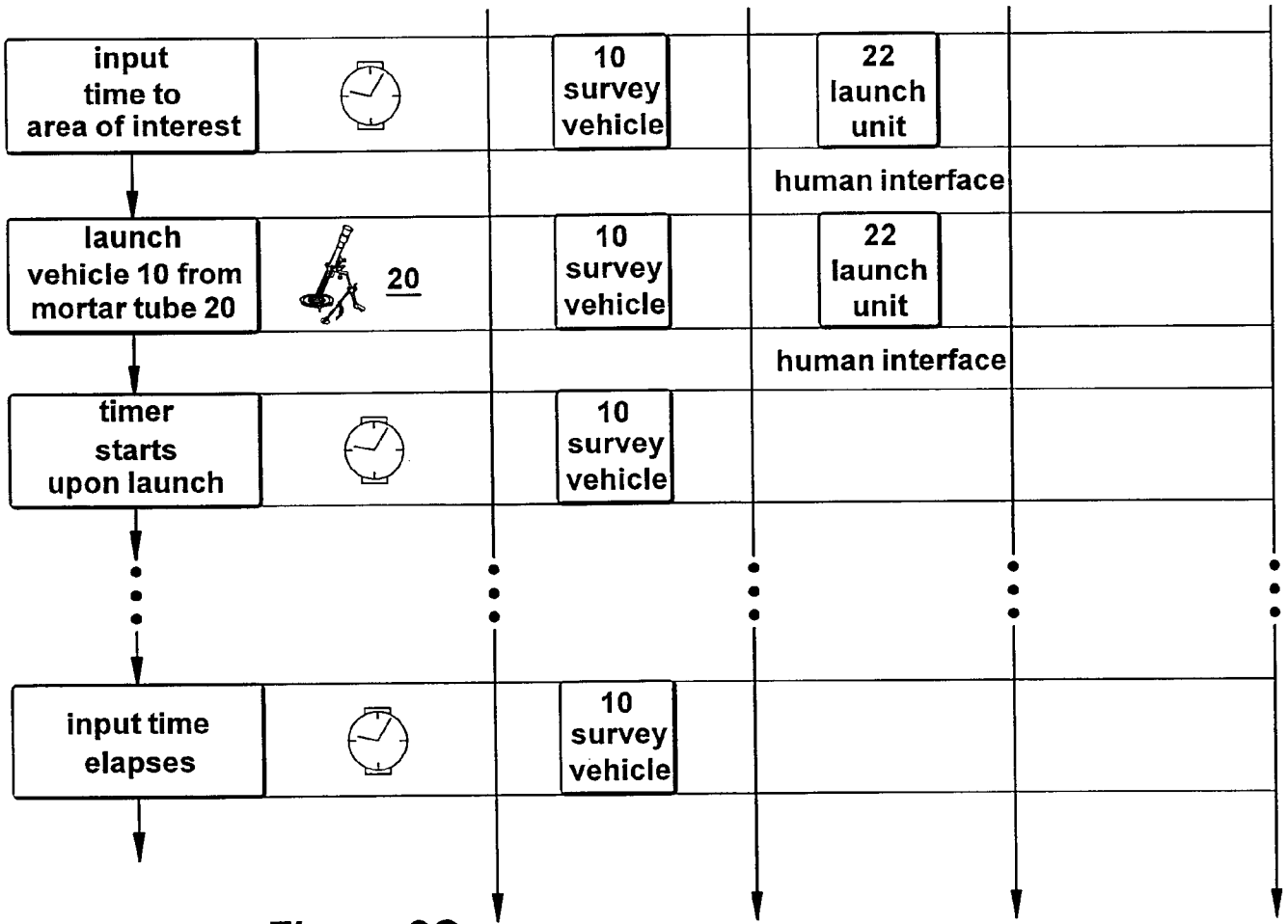
Figure 8D:
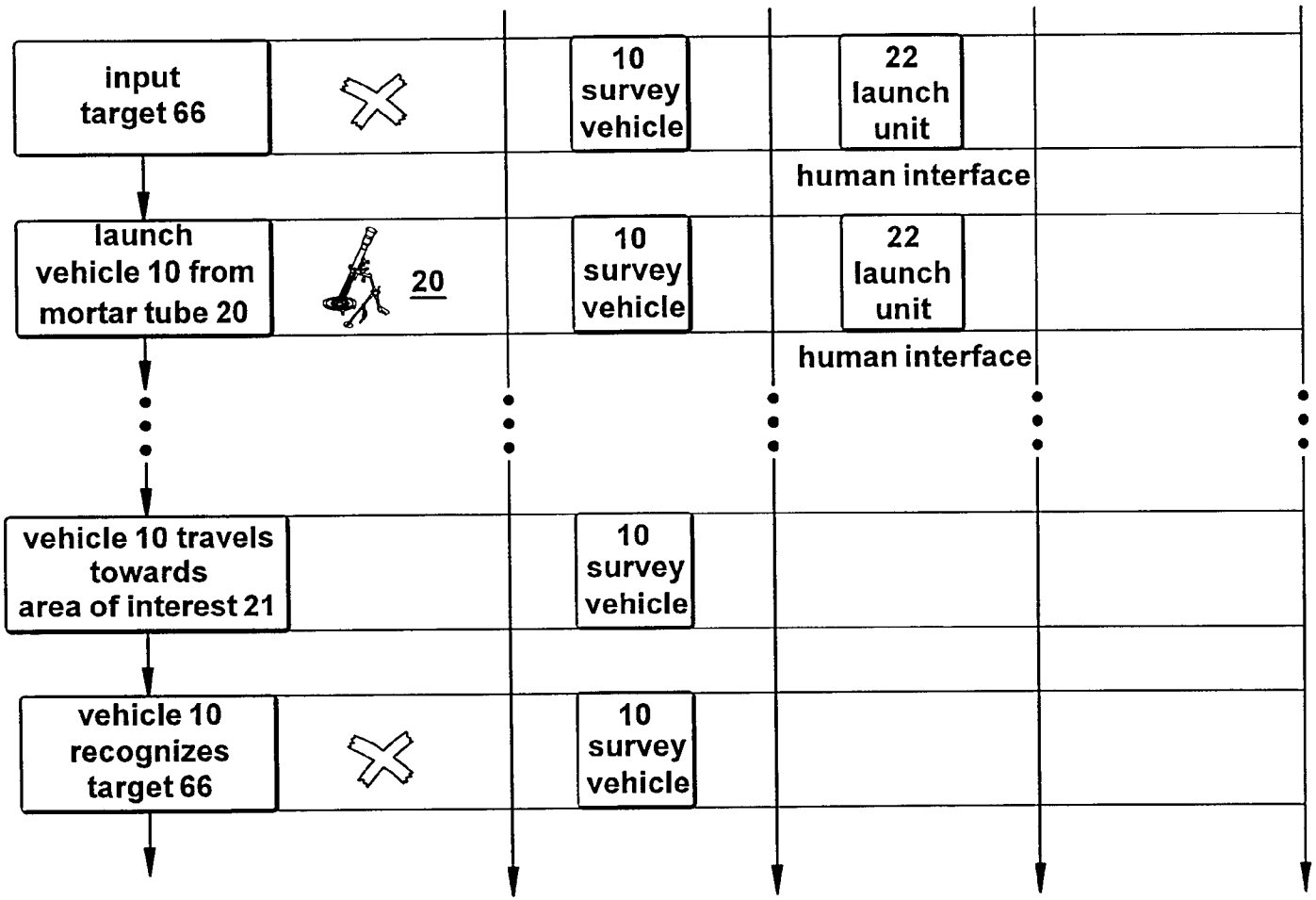
Figure 8E:
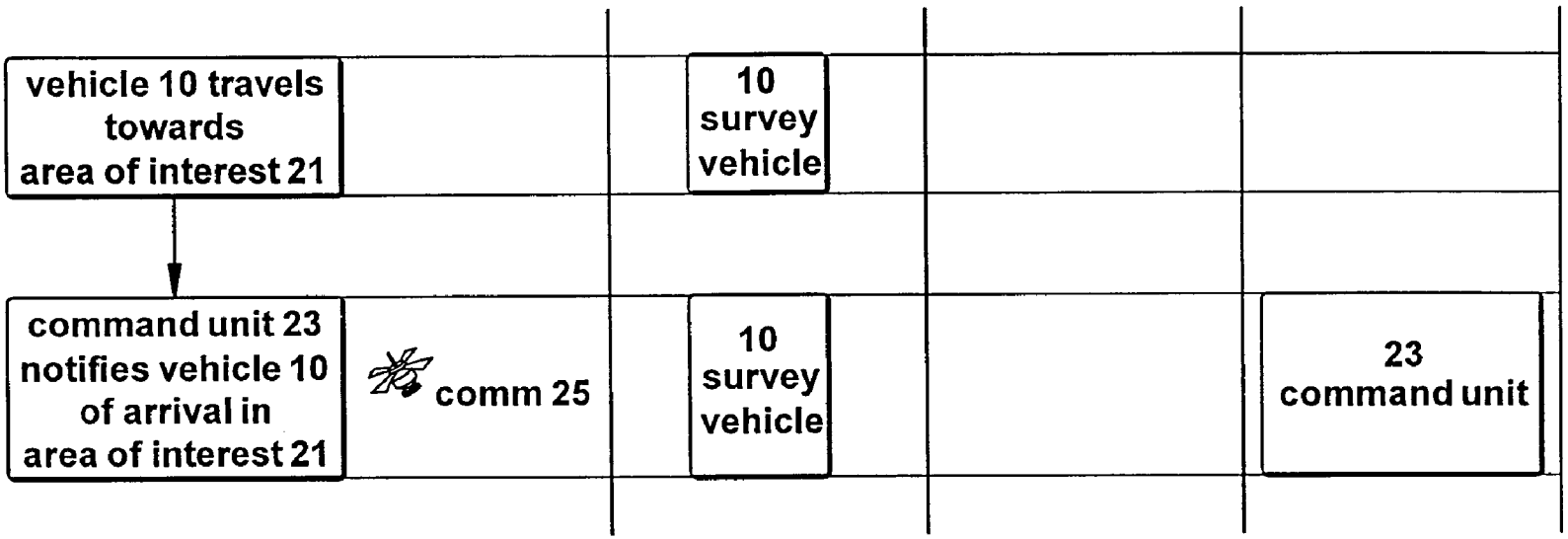

When the vehicle 10 ascertains arrival at the area of interest 21, the parasail 12 is deployed and the propulsion device 33 is dropped. (FIG. 7A.) This ascertainment can be accomplished in a variety of ways. For example, the vehicle 10 can continuously obtain its current global position (via its positioner 50) and compare this to the global position of the area of interest 21 (e.g., input prior to launch). (see FIG. 8A). Arrival at the area of interest 21 can be determined by the vehicle 10 reaching a certain altitude. (see FIG. 8B.) The elapsing of a predetermined period of time can be the indication of arrival in the area of interest 21. (see FIG. 8C.) If the vehicle 10 is equipped with target-seeking instrumentation, a sighting of the target 66 can mean area-of-interest arrival. (see FIG. 8D.) And/or the command unit 23 can notify the vehicle 10 of its arrival in the area of interest 21. (see FIG. 8E.)

Figure 9A:
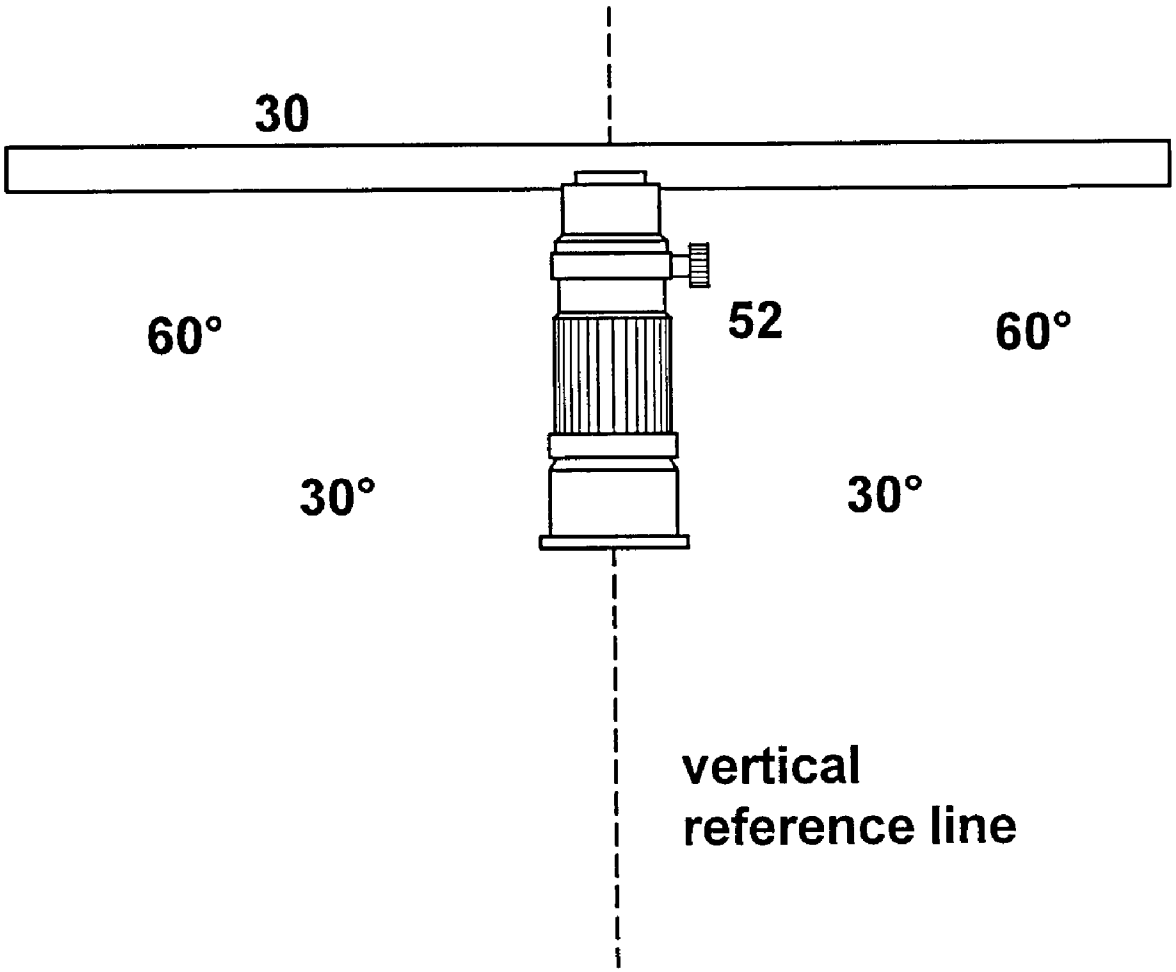
Figure 9B:
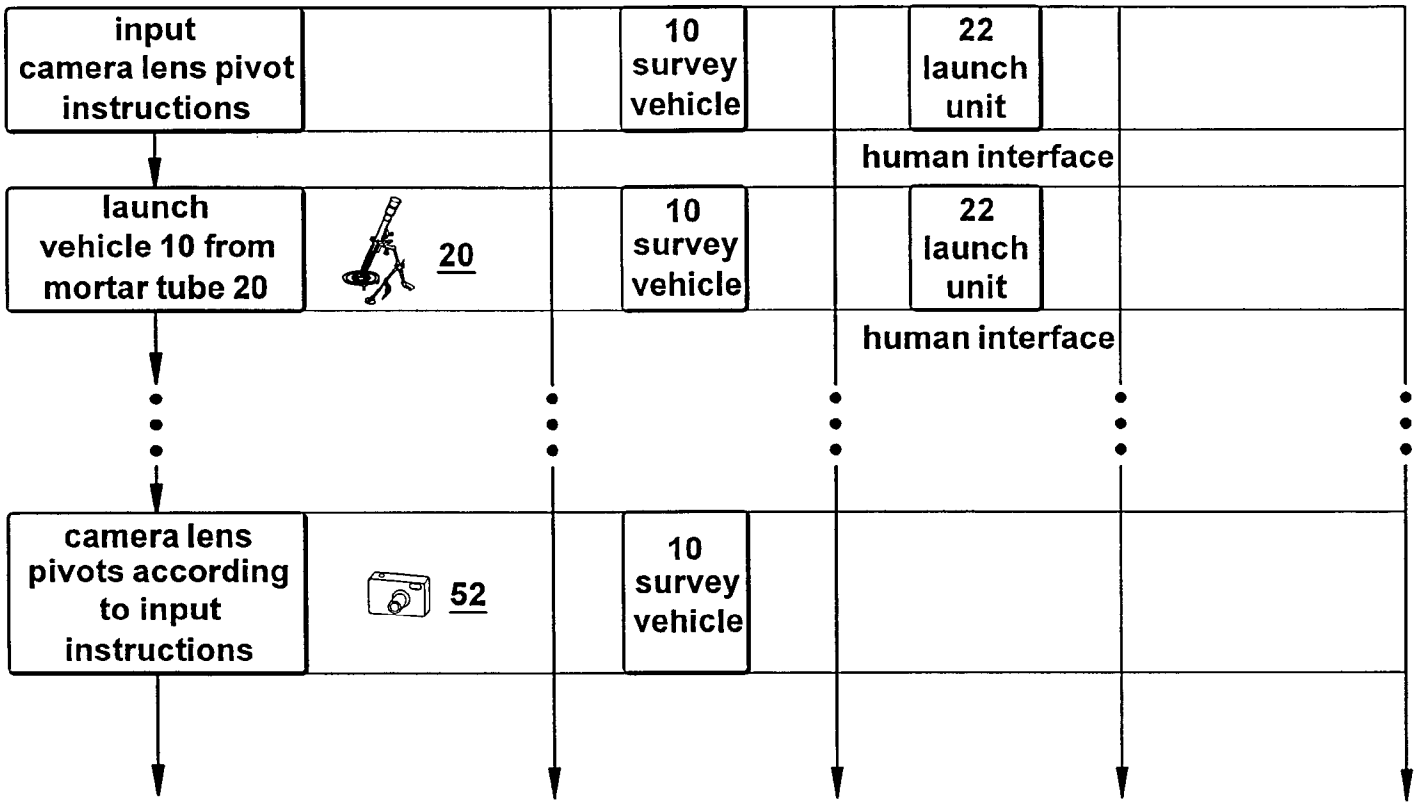
Figure 9C:
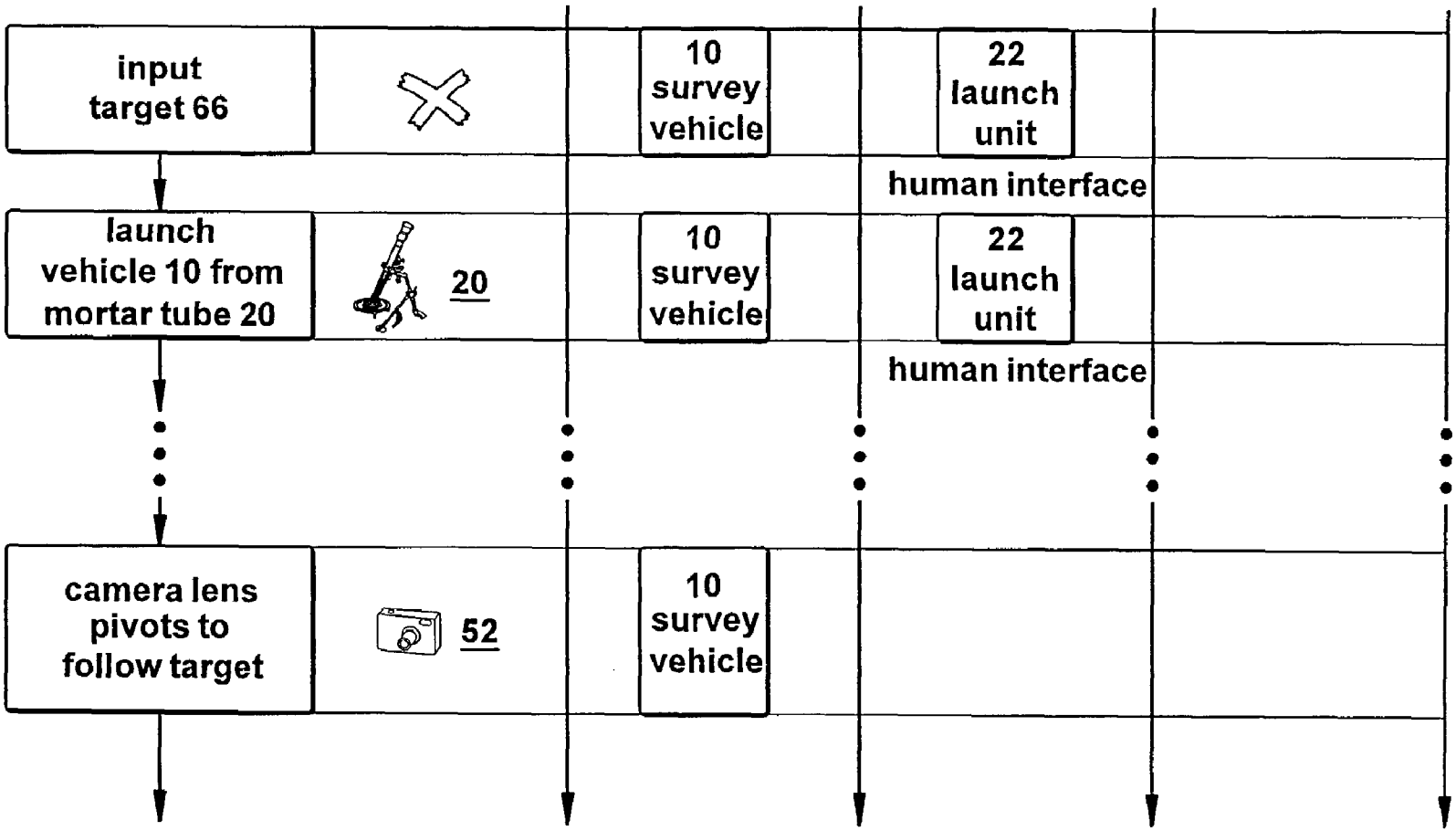
Figure 9D:
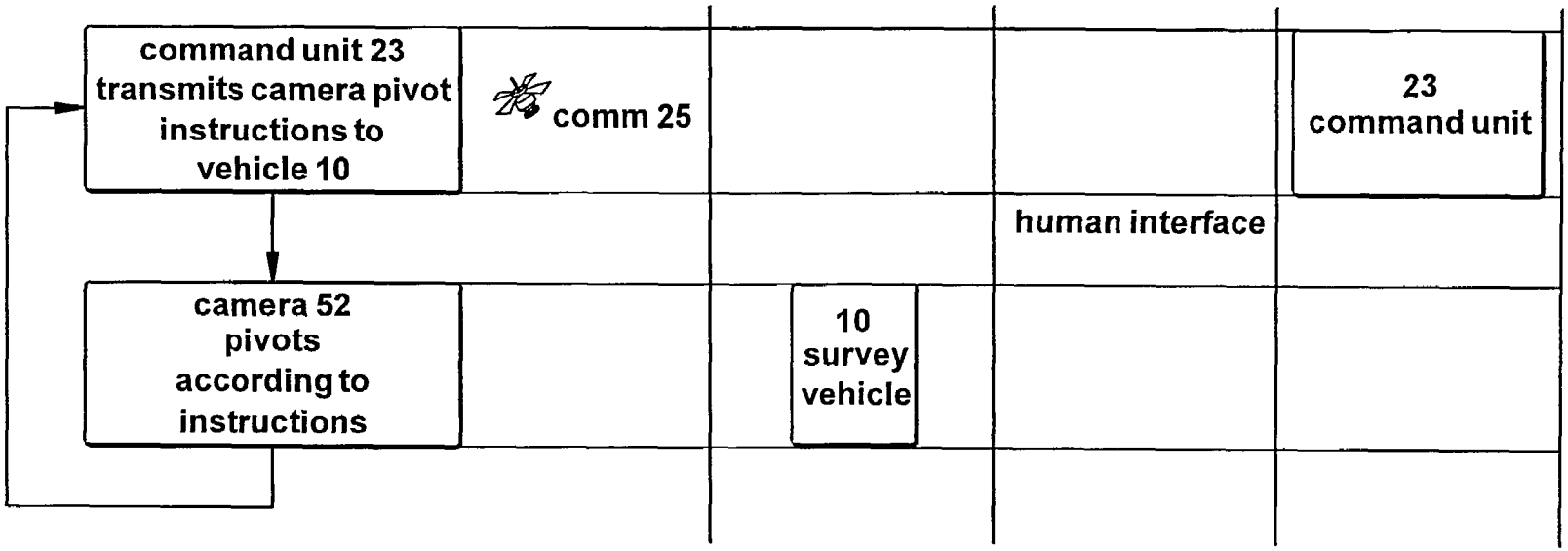

Once in the area of interest 21, the vehicle 10 collects visual survey data (e.g., via collector 52). (FIG. 7A) The collector 52, or at least its collecting lens, can be mounted for pivotal movement relative to the vehicle canister 30 (see FIG. 9A.) By pivoting or otherwise moving the collecting lens, the field of view can be adjusted. Pivoting/adjusting instructions can be preprogrammed (see FIG. 9B) or provided by the command unit 23 (see FIG. 9D). Additionally or alternatively, collecting-lens movement can follow a locked-onto target 66 (see FIG. 9C).

Figure 10A:
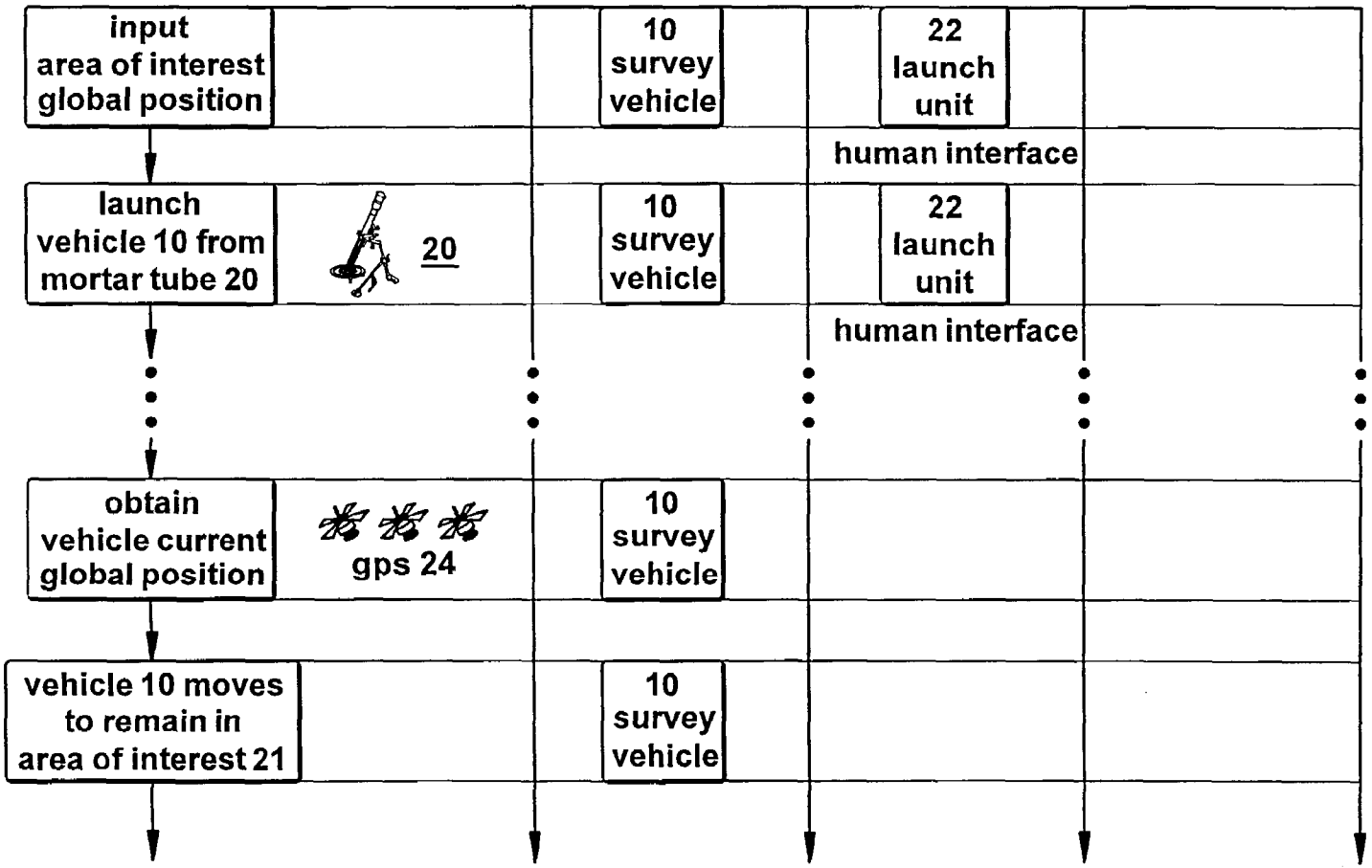
Figure 10B:
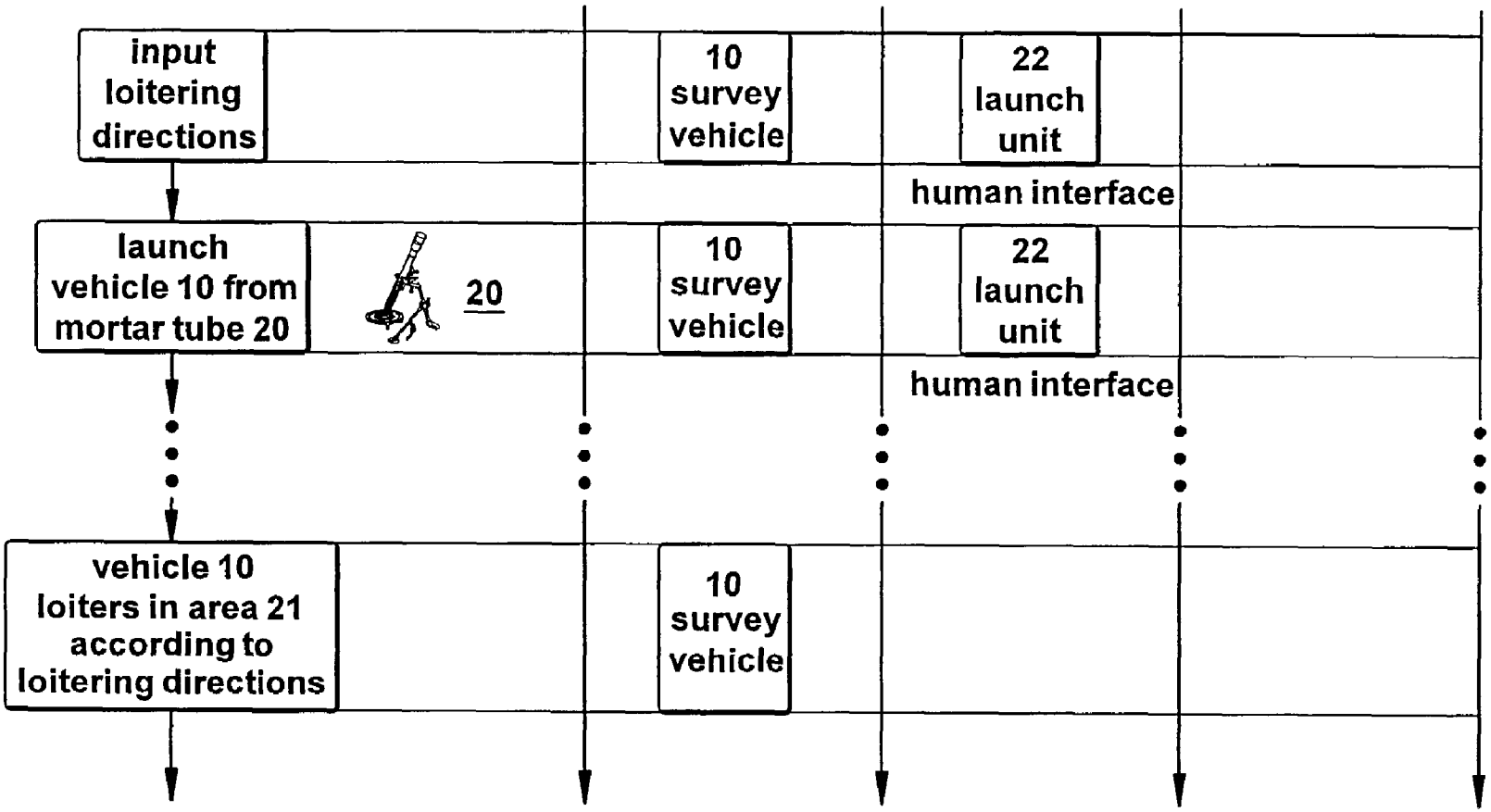
Figure 10C:
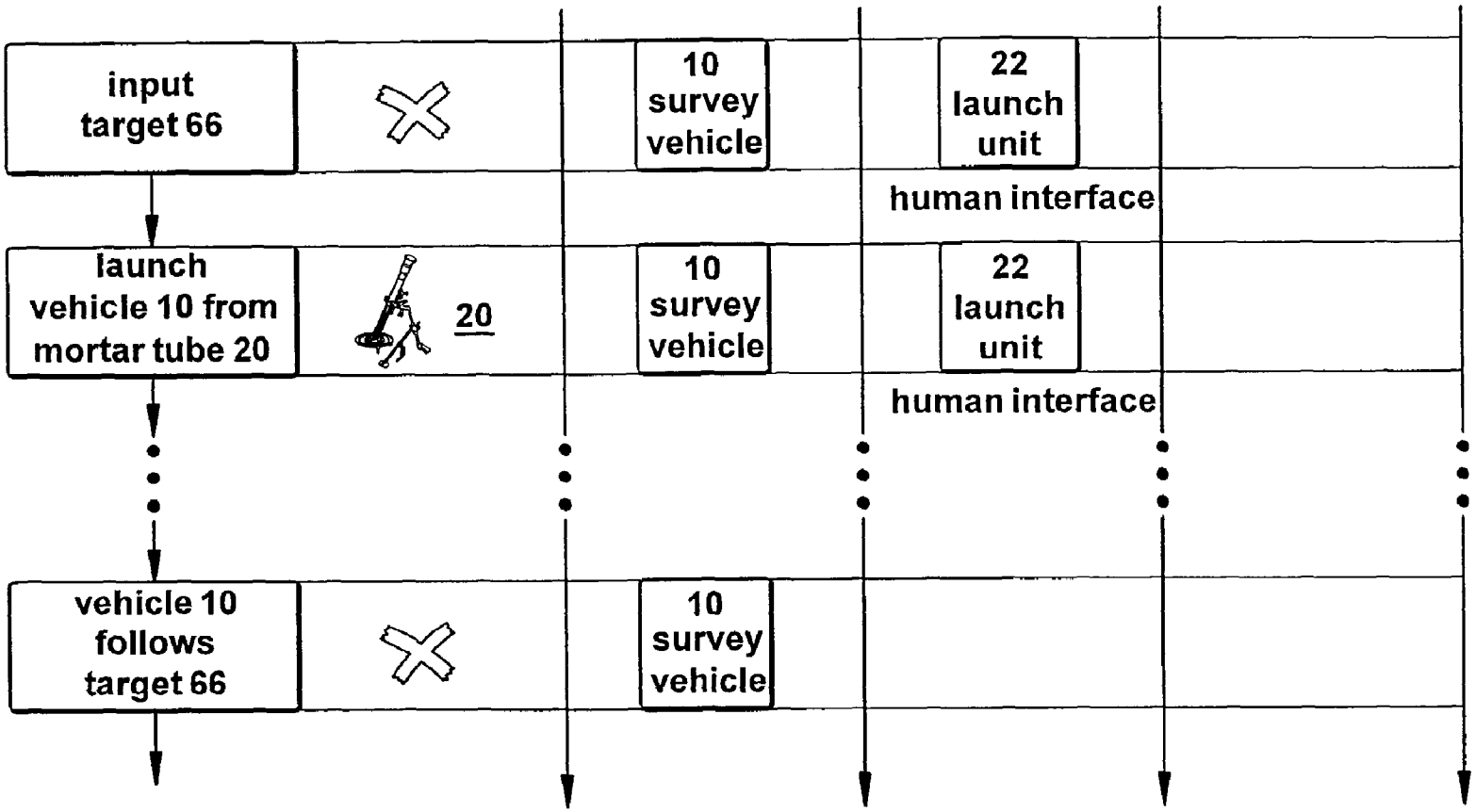
Figure 10D:
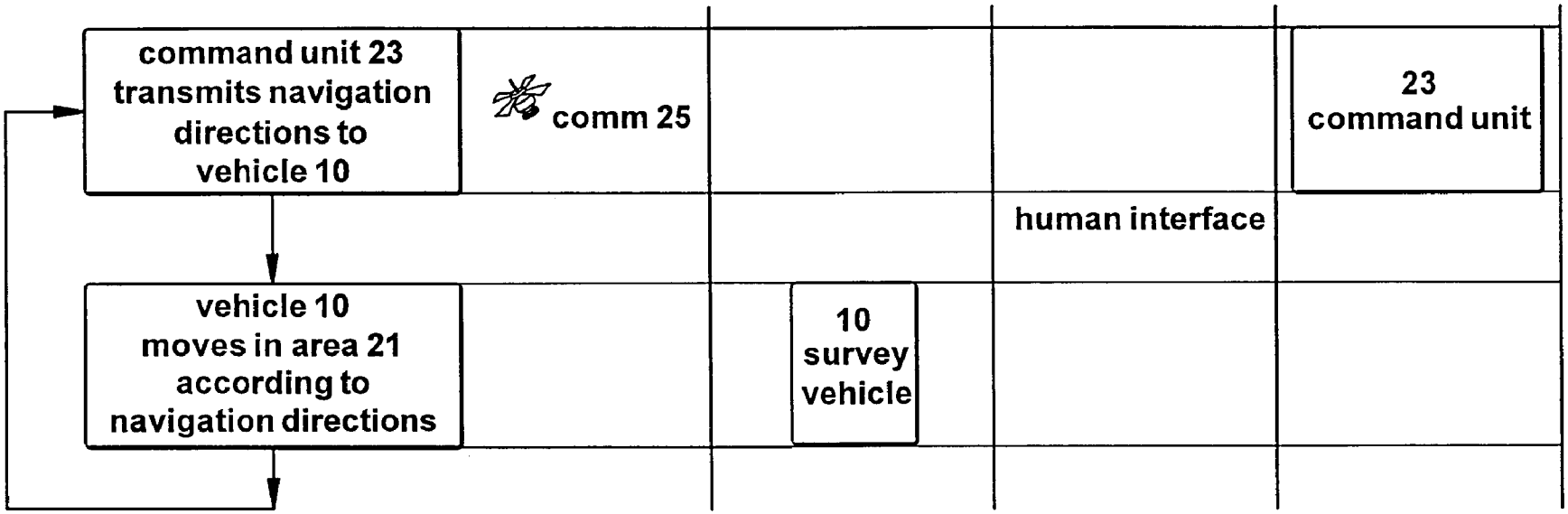

The vehicle 10 moves aerially in the area of interest 21 while collecting, processing, and transmitting the visual survey data. (FIG. 7B.) This maneuvering is effected by the parasail 12 (e.g., pulling of its lines 18) and/or the propulsion device 33 (e.g., speed/direction of motor 47). The vehicle 10 can initiate movement to remain in the area of interest 21 when global position data indicates a drifting therefrom (see FIG. 10A). The vehicle 10 can loiter in the area of interest 21 in accordance with preprogrammed loitering directions (see FIG. 10B). The vehicle's movement can be steered by a target 66 onto which it is locked (see FIG. 10C). And/or the vehicle 10 can move according to navigation instructions transmitted by the command unit 23 (see FIG. 10D).

The vehicle 10 transmits the collected survey data (e.g., via transmitter 54) to the command unit 23. Preferably, the survey data is processed (via processor 53) before transmittal to the command unit 23. This processing can include, for example, compensating for vehicle movement so that the transmitted data is stabilized. Image processing can instead be done at the command unit 23 or another transmitted-to location. But pre-transmittal processing of the data eliminates the need for the survey-data recipient to have accommodating processing equipment.

The command unit 23 receives the survey data (via receiver 60), and it maps and analyzes this data (via mapper 61 and analyzer 64). This mapping/analysis leads to identification of target 66 (via identifier 65), so that target pursuit can be planned (via planner 67). The target 66 can be then be pursued, as ordered by the command unit 23 (via commander 68).

Figure 12A:
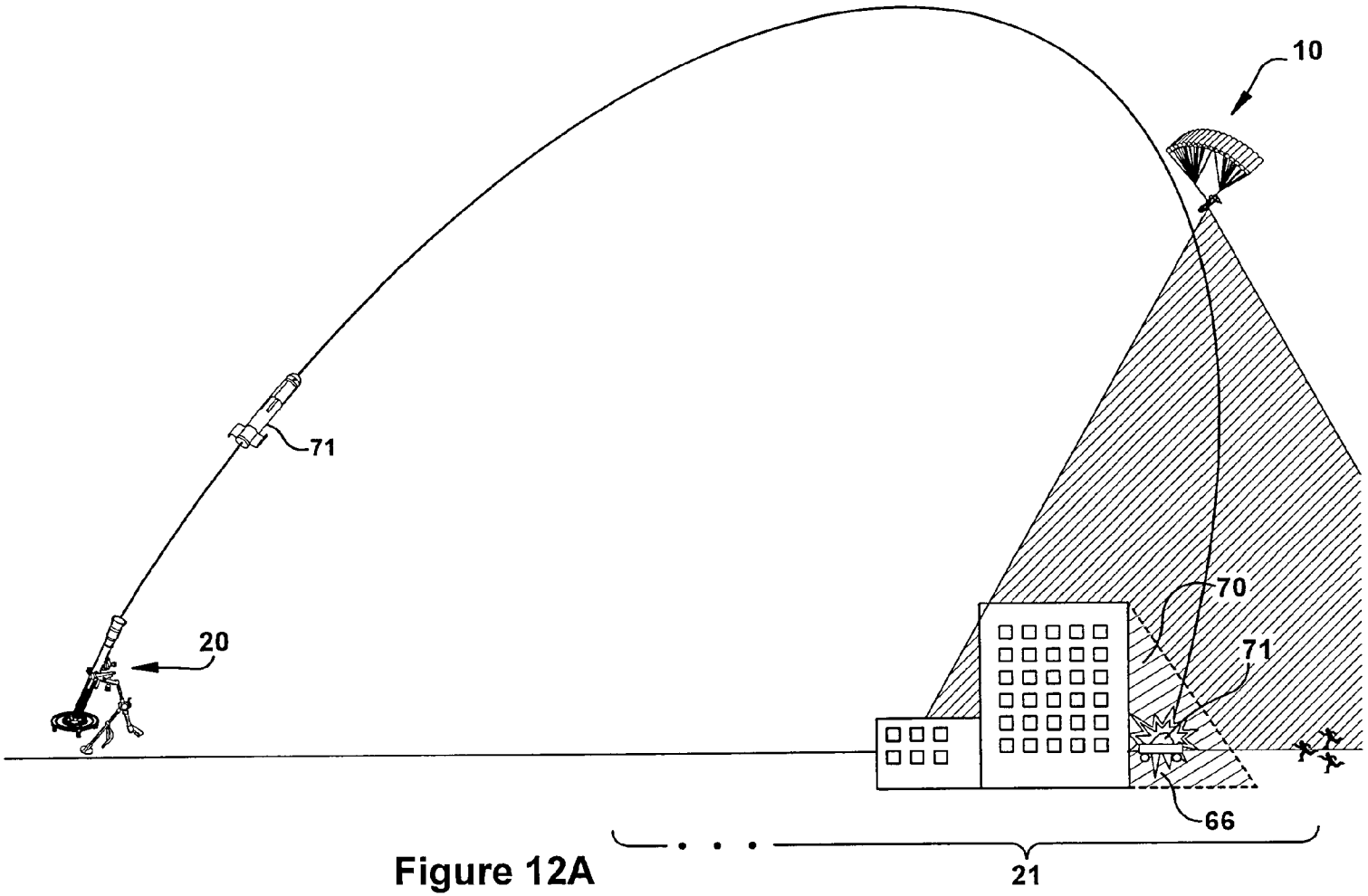
Figure 12B:
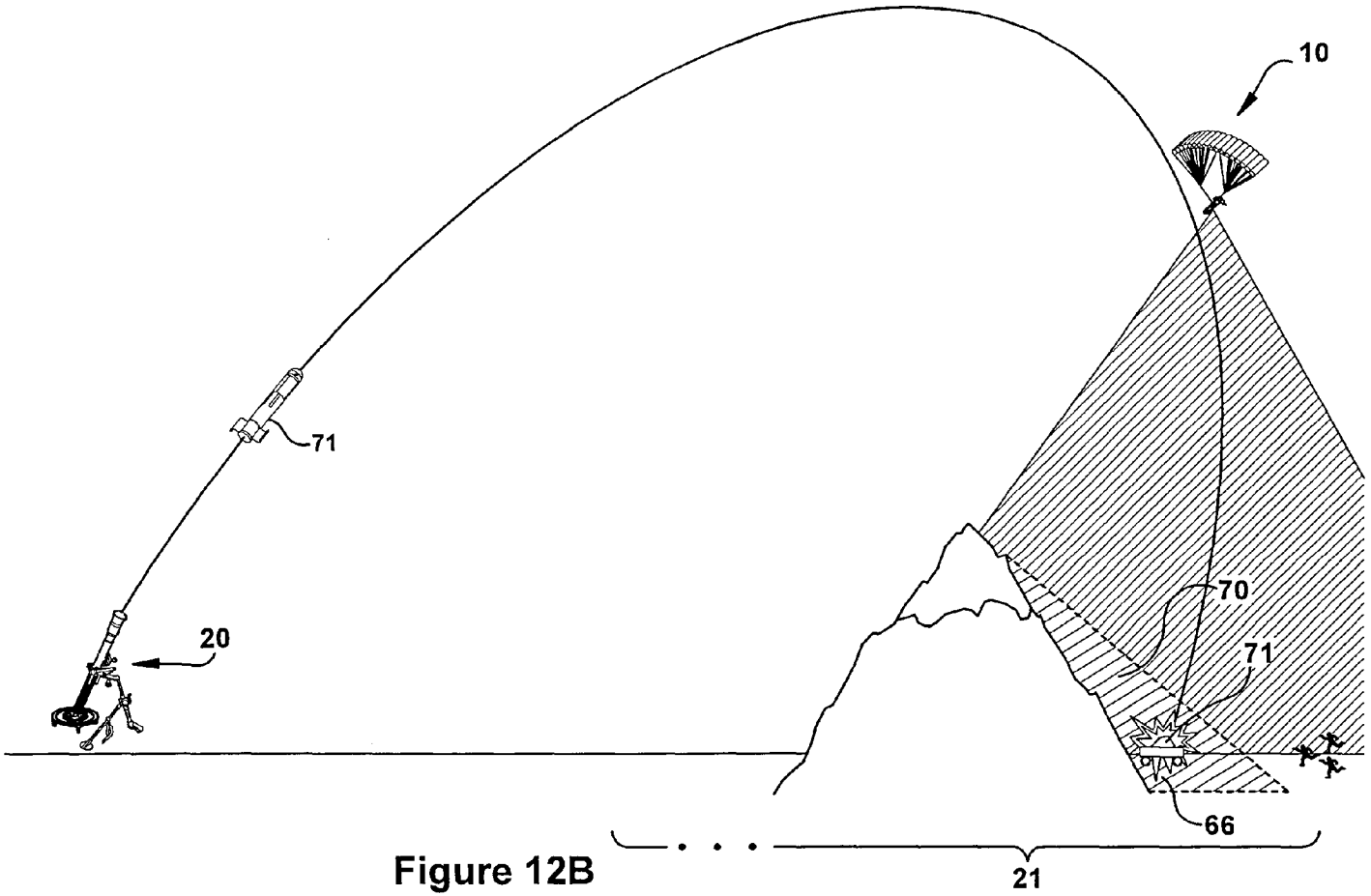

The surveying ability of the vehicle 10 can be especially advantageous for dead-space combat when combined with self-guiding weapons. Referring briefly to FIG. 12A, a dead space 70 is located "behind" a building, the orientation being relative to the location of the launch tube 20. The relevant dimensions of the dead space 70 can be estimated at being about ½ of the building's height. Needless to say, in a city crowded with buildings, dead spaces for the enemy to hide would not be in short supply. As shown in FIG. 12B, the same phenomenon can occur with natural obstacles, such as mountains. In either or any event, once the dead space 70 has been identified as target 66 by the command unit 23, its exact global position can be programmed into a precision guided mortar round 71, and/or any GPS guided round.

Figure 11A:
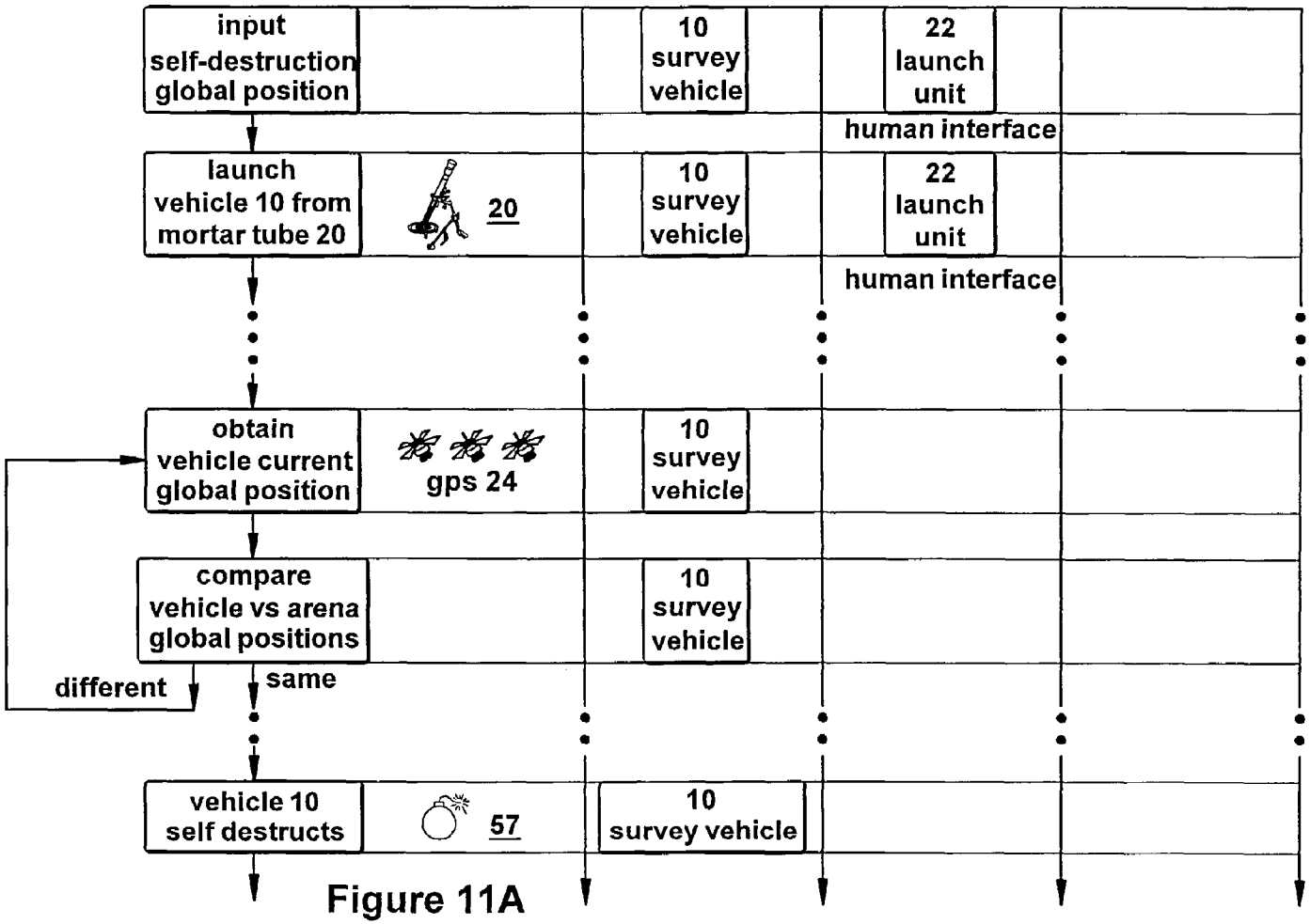
Figure 11B:
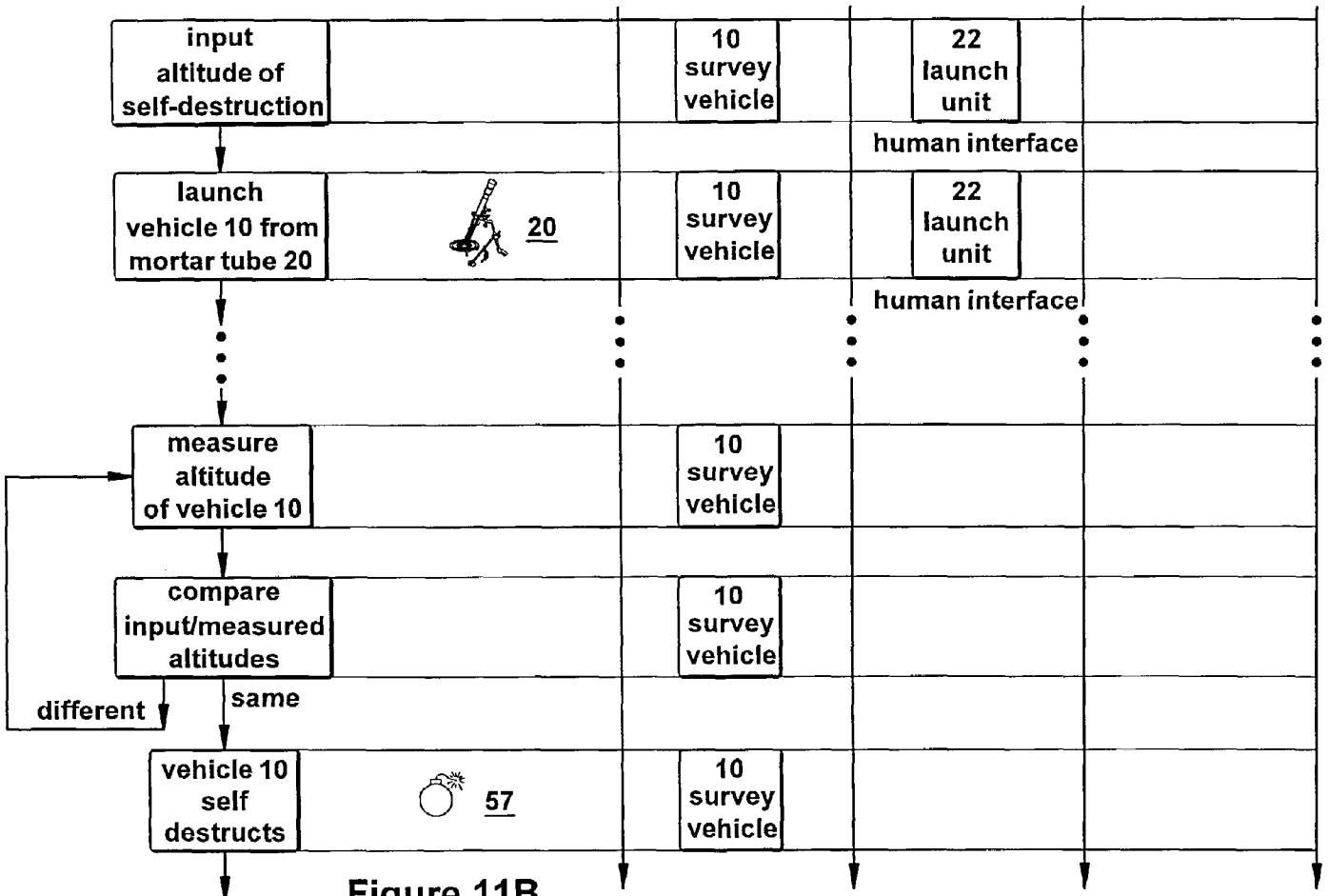
Figure 11C:
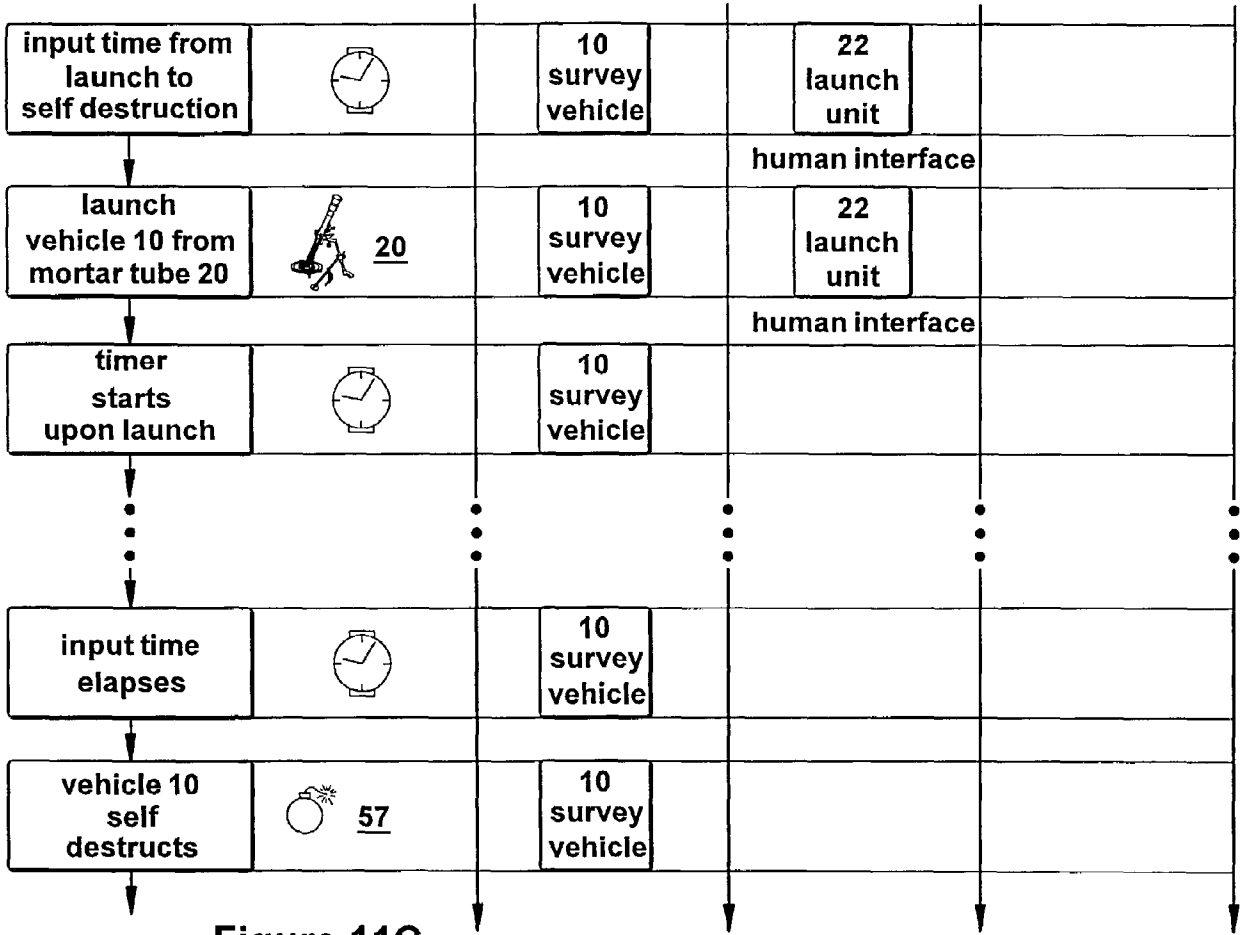
Figure 11D:
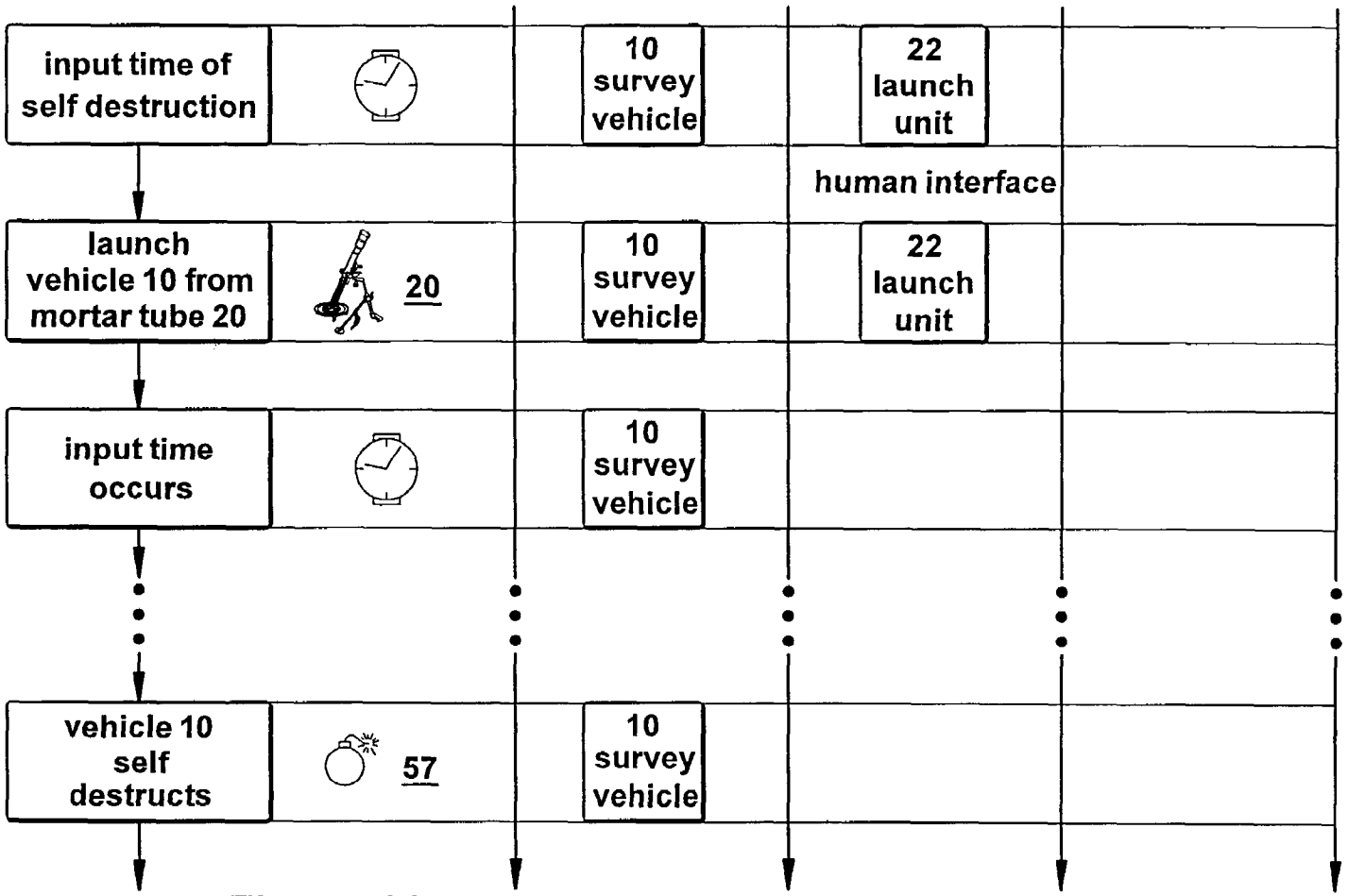
Figure 11E:
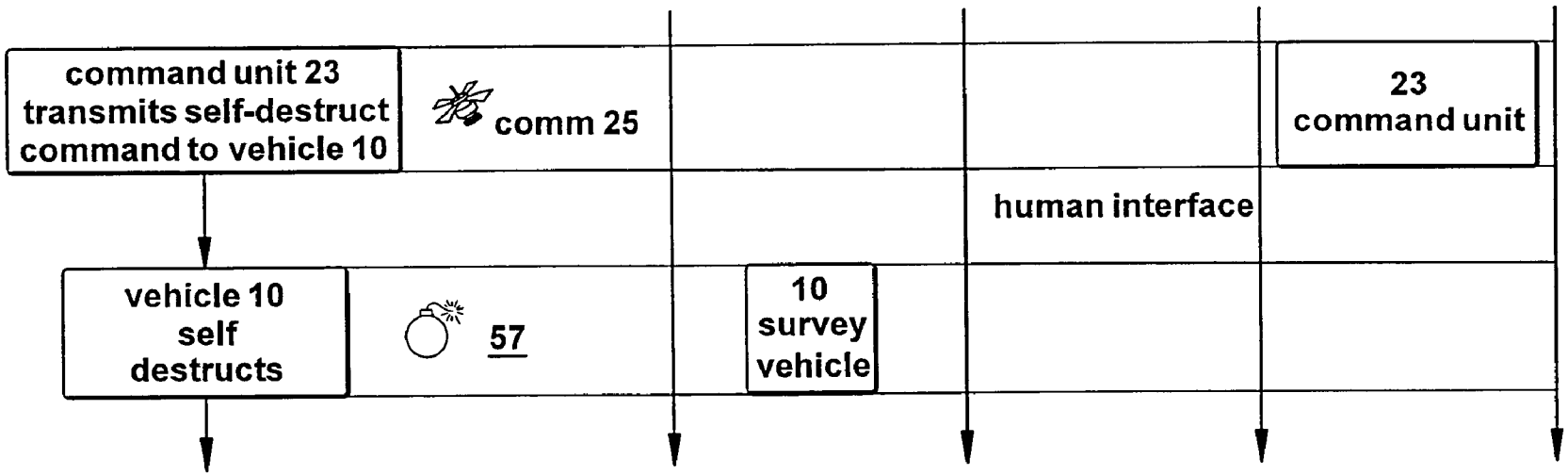

The vehicle 10 can be designed to self-destruct (via its self-destructor 57) to avoid, for example, confiscation by the enemy. (FIG. 7C.) This self-destruction can be initiated by entering a predetermined global position (see FIG. 11A), descending to an undesirable altitude (see FIG. 11B), spending a pre-set period of time in the air (FIG. 11C), coming of specified time (see FIG. 11D), and/or receiving a command from the unit 23 to self destruct (see FIG. 11E).

Figure 13:
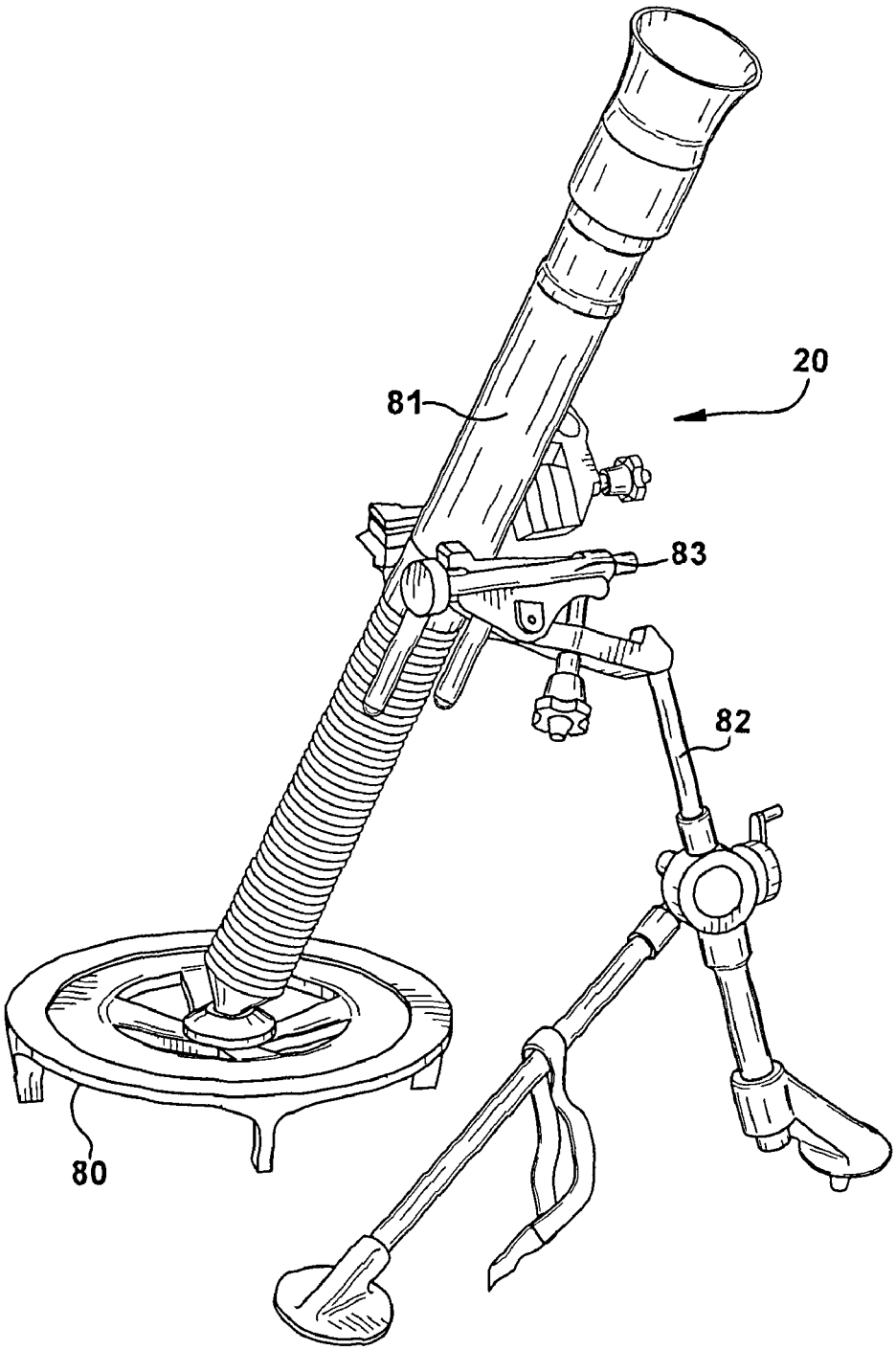
FIG. 13 shows a standard launch tube 20 for launching the surveillance vehicle 10 (and possibly subsequent ammunition rounds).
Figure 14A:
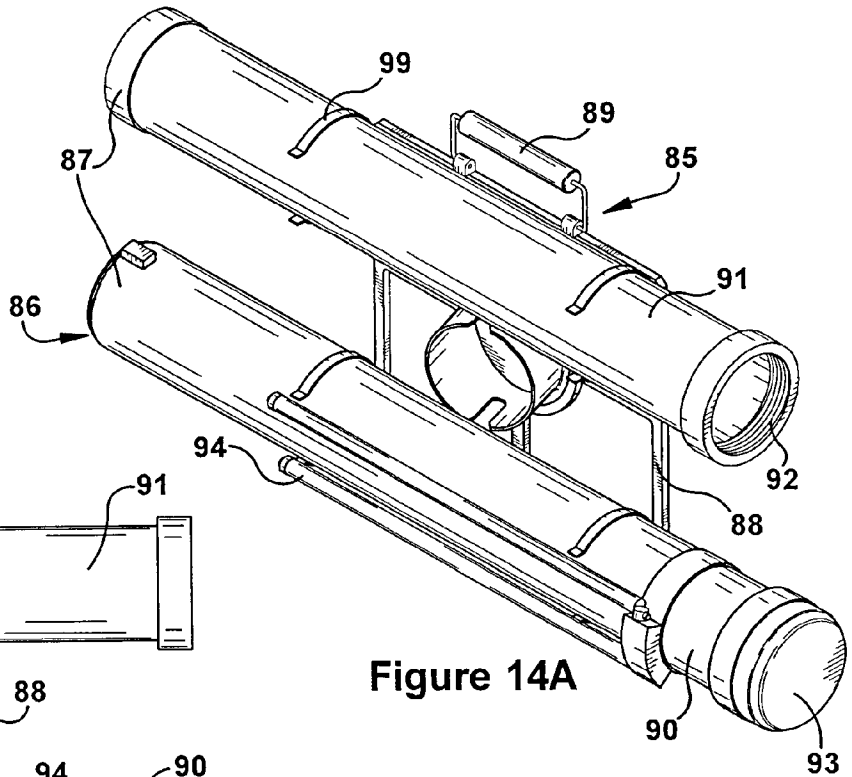
FIGS. 14A-14G show a portable kit 86 (and components thereof that includes a surveillance vehicle 10 and launch equipment therefor.
Figure 14B:
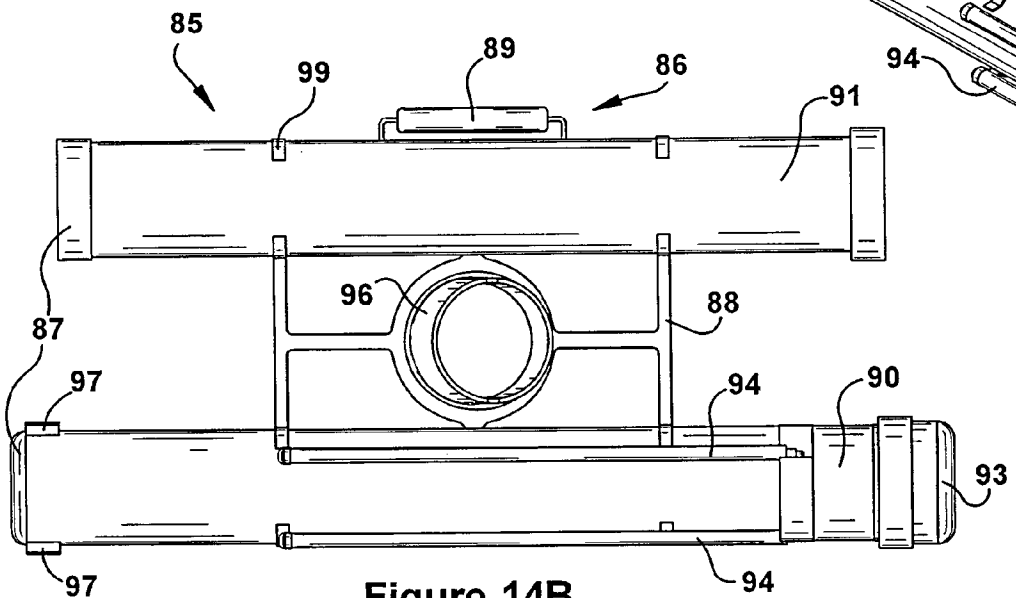
Figure 14C:
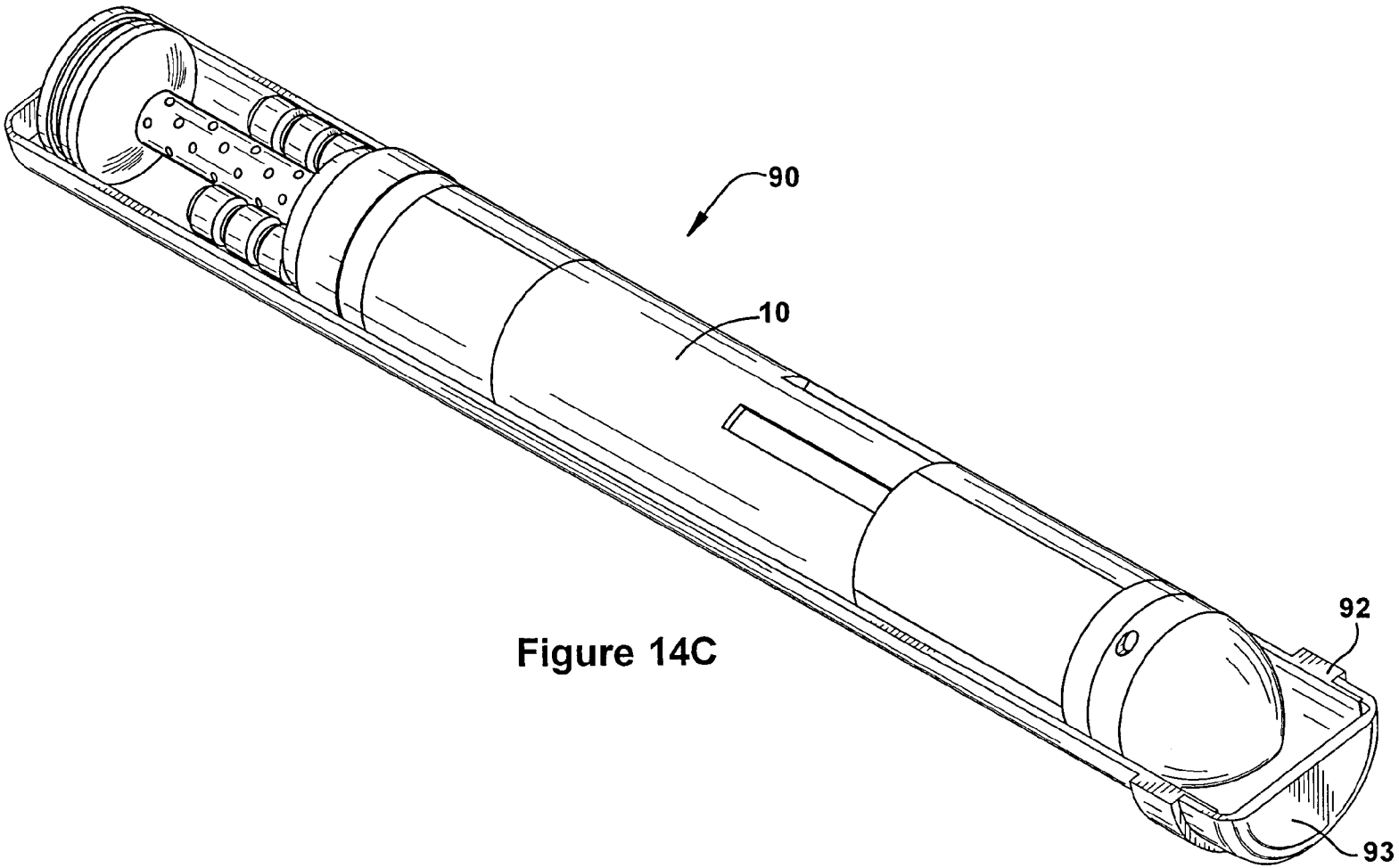
Figure 14D:
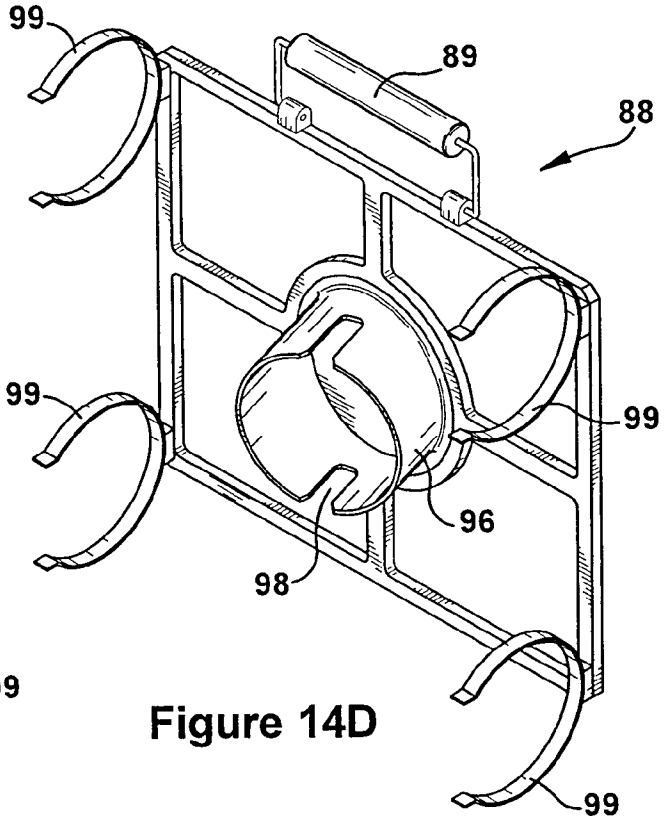
Figure 14E:
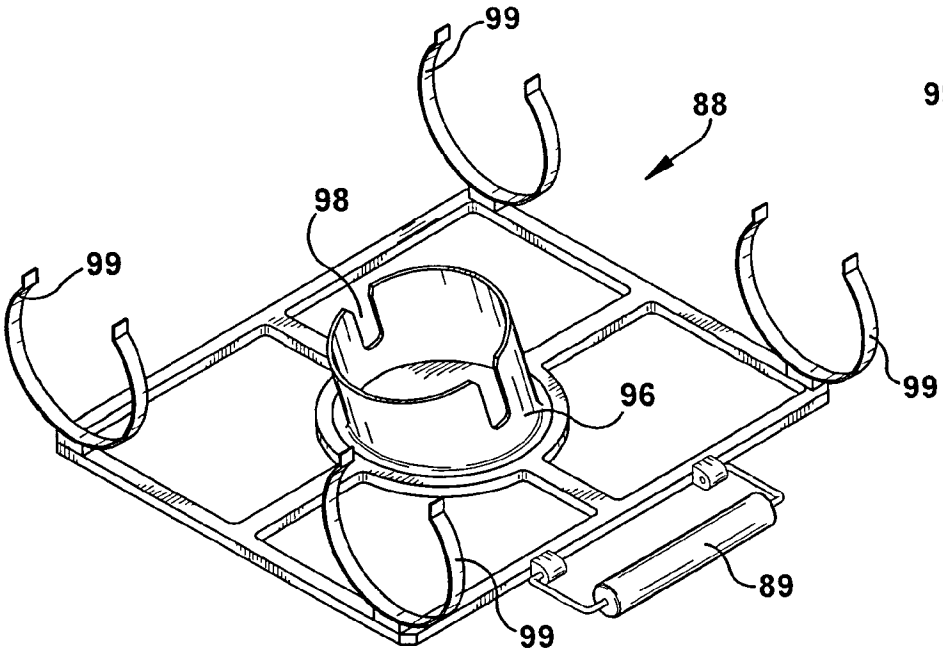
Figure 14G:
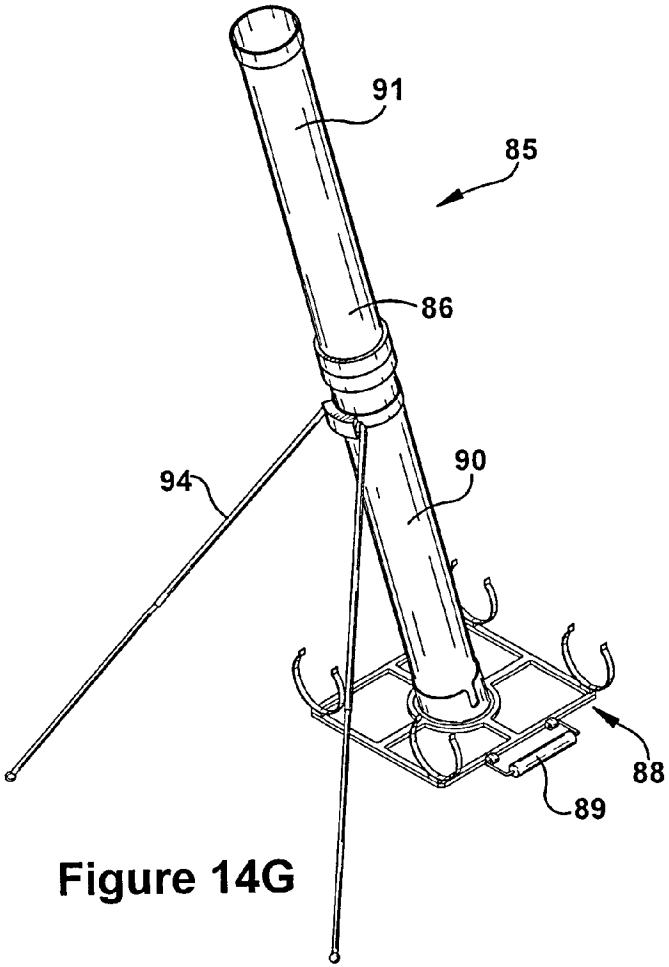
Figure 14F:
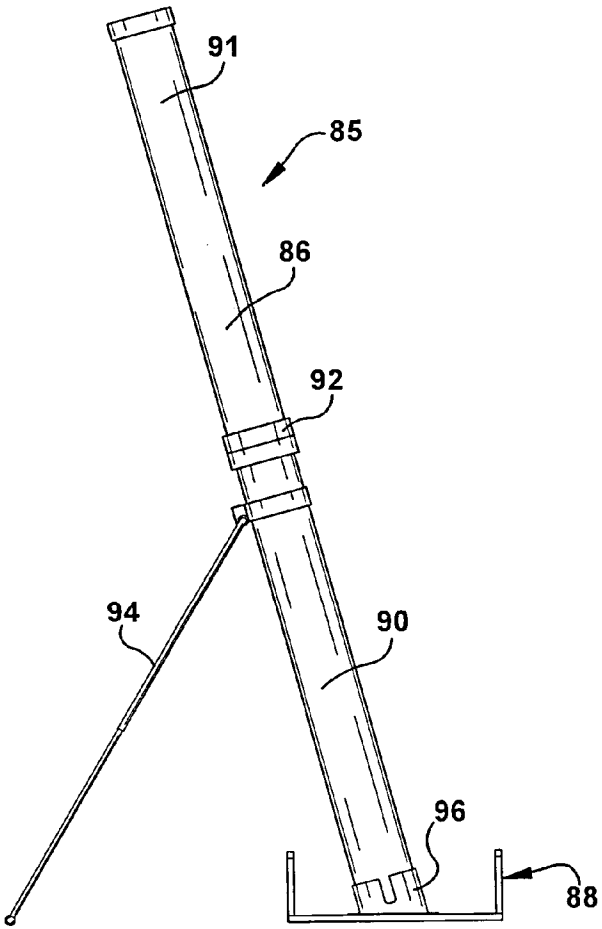

As alluded to above, the launch tube 20 can be a conventional or standard component used to launch mortar rounds. As shown in FIG. 13, such a tube 20 typically comprises a base 80, a barrel 81, an easel 82 and an adjustable clamp 83. The base 80 is anchored in the ground, while the easel 82 and the clamp 83 hold the barrel 81 at the correct orientation. The tube 20 is intended for repeated use in demanding combat climates. It is usually made of a heavy steel and weighs upward of 100 pounds, without the payload.

The vehicle 10 can instead be part of a portable kit 85, such as is shown in FIGS. 14A-14G, that can be toted (on foot) to the desired launch location. The portable kit 85 can include single-use launch tube 86 (i.e., it is retired after launch of the vehicle 10). The launch tube 86 can be fabricated primarily of lightweight composites so that the weight of the kit 85 can be kept below fifty pounds, forty pounds, and/or thirty pounds. The combined cost of the vehicle 10 and the single-use tube 86 could be within a range allowing one to be kept in inventory by even relatively humble emergency response organizations.

The launch tube 86 comprises a barrel 87, a stand 88, and a handle 89. In the illustrated embodiment, the launch tube 86 comprises a barrel pipe 90 and a barrel pipe 91 connected together end-to-end by threaded connections 92. The vehicle 10 is contained within the barrel pipe 90 and a lid 93 seals the pipe's open upper end prior to launch. Locking or anti-tampering means can be incorporated into this closure for security purposes, so that the kit 85 can be kept with other emergency equipment until a situation arises. The pipe 90 is provided with a kickstand-like brace structure 94 for angling the barrel 87 for the desired launch projectile.

The stand 88 has a base mount 96 for receipt of the bottom end of the barrel 87 which, in the illustrated embodiment, is the bottom end of the barrel pipe 90. Mating tabs 97 and slots 98 on the base mount 96 lock the barrel 87 against rotational movement. These locking components 97/98, in combination with the brace structure 94, hold the barrel 87 in a steady launch position.

The stand 88 can double as a rucksack for the launch tube 86 so that no extra weight or cost is added for suitcasing of the launch tube 86. The handle 89 can be attached to the stand 88 for convenient carrying. And the stand 88 can comprise clamps 99 for clamping the barrel pipes 90 and 91 when carrying the kit 85 to a proposed launch site.

One may now appreciate that the surveillance vehicle 10 can gather meaningful intelligence from an effective vantage point without endangering human life. Although the surveillance vehicle 10 has been shown and described with respect to a certain embodiment or embodiments, it is obvious that equivalent alterations and modifications will occur to others skilled in the art upon the reading and understanding of this specification and the annexed drawings. In regard to the various functions performed by the above described elements (e.g., components, assemblies, systems, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A surveillance vehicle comprising a vessel and a parasail, wherein the vessel comprises:

a canister having a stowage space in which the parasail is stowed, a sail deployer triggerable to deploy the parasail from the stowage space, a propulsion device for aerial movement of the vessel to an area of interest, a controller ascertaining arrival at the area of interest and triggering the sail deployer to deploy the parasail upon arrival above the area of interest, and a collector for collecting visual survey data from the area of interest;

wherein:

the vehicle is convertible from a pre-launch condition to a survey condition, when the vehicle is in the pre-launch condition, the parasail is stowed within the stowage space and the vessel is sized and shaped for launch from a mortar tube, when the vehicle is in the survey condition, the parasail is deployed from the stowage space and the vessel is supported thereby at an altitude of at least 100 feet;

wherein the propulsion device includes a propeller, and a propeller motor used to drive the propeller;

wherein the parasail includes:

a canopy;

cords connected to the canopy; and pull lines connecting the cords to the vessel; and wherein the pull lines are attached to deployment arms within the vessel, to pull and/or pivot the pull lines after the parasail is deployed, to direct travel of the vehicle.

2. A surveillance vehicle as set forth in claim 1, wherein the canister has a compartment holding the propulsion device, and wherein the controller prompts the propulsion device to drop from the compartment upon arrival at the area of interest.

3. A surveillance vehicle as set forth in claim 1, wherein the vessel further comprises a transmitter transmitting collected survey data to a command unit remote from the area of interest.

4. A surveillance vehicle as set forth in claim 1, wherein the vessel further comprises a positioner having an antenna for obtaining the global position of the vehicle, and wherein the positioner has an input for inputting the global position of the area of interest, whereby the controller can ascertain arrival at the area of interest based on the input global position of the area of interest and the obtained global position of the vehicle.

5. A surveillance vehicle as set forth in claim 1, wherein the controller ascertains arrival at the area of interest based on the altitude of the vessel, based upon time elapsed from launch of the vessel, and/or based upon recognition of a target.

6. A surveillance vehicle as set forth in claim 1, wherein the controller ascertains arrival at the area of interest and triggers the sail deployer without human interface.

7. A surveillance vehicle as set forth in claim 1, wherein the controller controls the parasail and/or a propulsion unit to move within the area of interest based upon:

a comparison between the global position of the vehicle and the global position of the area of interest;

pre-programmed loitering directions;

a locked-on target and movement thereof; and/or navigation directions received from a remote command unit.

8. A surveillance vehicle as set forth in claim 1, wherein the collector comprises a collecting lens, wherein the collecting lens is mounted for movement relative to the canister.

9. A surveillance vehicle as set forth in claim 8, wherein the collecting lens of the collector is mounted for pivotal movement relative to the canister, and wherein the collecting lens is movable without human interface and/or based upon instructions received from a command unit remote from the area of interest.

10. A surveillance vehicle as set forth in claim 1, wherein the vessel further comprises a processor which processes image data collected by the collector, and wherein the processor compensates for movement of the vessel.

11. A surveillance vehicle as set forth in claim 1, wherein the vessel has a diameter less than 200 mm when the vehicle is in its pre-launch condition.

12. A surveillance vehicle as set forth in claim 11, wherein the vessel has a 60 mm diameter, an 81 mm diameter, a 105 mm diameter, or a 155 mm diameter when the vehicle is in its pre-launch condition.

13. A surveillance vehicle as set forth in claim 1, further comprising a self-destructor that is activated upon occurrence of predetermined event.

14. A surveillance vehicle as set forth in claim 1, in combination with a command unit, wherein:

the surveillance vehicle is in its survey condition and located in the area of interest and the command unit is located remote from the area of interest, the command unit comprises a receiver that receives collected survey data transmitted by the surveillance vehicle, and the command unit also comprises a mapper that maps the received survey data and/or an image screen that displays the survey data.

15. A surveillance vehicle as set forth in claim 1, in combination with a command unit that maps/displays survey data received from the surveillance vehicle, wherein the command unit comprises a target identifier that identifies a target on the mapped/displayed survey data, and wherein the target identifier requires human interface to identify the target.

16. A surveillance vehicle as set forth in claim 1, in a portable kit further comprising a launch tube with a barrel, and wherein the surveillance vehicle is sealed within the barrel in the pre-launch condition.

17. The surveillance vehicle of claim 1, wherein the vessel further comprises an NBC detector for detecting nuclear, biological, and/or chemical incidents in the area of interest, and/or a jammer for jamming radio communications in the area of interest.

18. A surveillance vehicle as set forth in claim 1, wherein the vessel has flight fins that spread outward from the canister during flight of the vehicle.

19. A surveillance vehicle as set forth in claim 1, further comprising openable doors that enclose the stowage space;

wherein the doors swing open when the deployment arms lift to deploy the parasail; and wherein the doors reclose after complete parasail deployment.

20. A surveillance vehicle comprising a vessel and a parasail, wherein the vessel comprises:

a canister having a stowage space in which the parasail is stowed, a sail deployer triggerable to deploy the parasail from the stowage space, a propulsion device for aerial movement of the vessel to an area of interest, a controller ascertaining arrival at the area of interest and triggering the sail deployer to deploy the parasail upon arrival above the area of interest, and a collector for collecting visual survey data from the area of interest;

wherein:

the vehicle is convertible from a pre-launch condition to a survey condition, when the vehicle is in the pre-launch condition, the parasail is stowed within the stowage space and the vessel is sized and shaped for launch from a mortar tube, when the vehicle is in the survey condition, the parasail is deployed from the stowage space and the vessel is supported thereby at an altitude of at least 100 feet;

wherein the propulsion device includes a propeller, and a propeller motor used to drive the propeller;

wherein the parasail includes:

a canopy;

cords connected to the canopy; and pull lines connecting the cords to the vessel;

wherein the sail deployer has deployment arms that are attached to the pull lines; and wherein the deployment arms are pivotally mounted to a pedestal that is within the canister.

* * * * *